US010267081B2

(12) United States Patent
Yokote et al.

(10) Patent No.: US 10,267,081 B2
(45) Date of Patent: Apr. 23, 2019

(54) MEDIUM HANDLING DEVICE

(71) Applicant: Oki Electric Industry Co., Ltd., Tokyo (JP)

(72) Inventors: Takamoto Yokote, Tokyo (JP); Masashi Kashiwabuchi, Tokyo (JP); Hiroshi Yokokawa, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 74 days.

(21) Appl. No.: 15/328,928

(22) PCT Filed: Jul. 14, 2015

(86) PCT No.: PCT/JP2015/070152
§ 371 (c)(1),
(2) Date: Jan. 25, 2017

(87) PCT Pub. No.: WO2016/067680
PCT Pub. Date: May 6, 2016

(65) Prior Publication Data

US 2017/0228957 A1 Aug. 10, 2017

(30) Foreign Application Priority Data

Oct. 29, 2014 (JP) ..... 2014-219850

(51) Int. Cl.
*E05G 1/12* (2006.01)
*G07D 11/00* (2006.01)

(52) U.S. Cl.
CPC ..... *E05G 1/12* (2013.01); *G07D 11/0006* (2013.01); *G07D 11/0021* (2013.01); *G07D 11/0042* (2013.01); *G07D 11/0084* (2013.01)

(58) Field of Classification Search
CPC .... E05G 1/00; E05G 1/12; E05G 1/14; G07D 11/0021; G07D 11/0042; G07D 11/0084
See application file for complete search history.

(56) References Cited

U.S. PATENT DOCUMENTS 5,598,793 A * 2/1997 Lopez, Jr. ..... E05G 1/14 109/25
5,787,819 A * 8/1998 Fumanelli ..... E05B 43/005 109/25
6,513,444 B2 * 2/2003 Walker ..... E05G 1/14 109/20

(Continued)

FOREIGN PATENT DOCUMENTS

JP 2006-252413 A 9/2006
JP 2010-055134 A 3/2010
JP 2011-224566 A 11/2011

*Primary Examiner* — Christopher J Boswell
(74) *Attorney, Agent, or Firm* — Rabin & Berdo, P.C.

(57) ABSTRACT

A medium handling device is provided including a stage on which a rectangular shaped medium is stacked in an vertical direction, and a liquid spraying mechanism including plural liquid spray nozzles that extend along the vertical direction and that spray a liquid at a medium stacked on an upper face of the stage. The plural liquid spray nozzles are respectively provided at positions facing at least three side edges of the stacked medium, and each of the plural liquid spray nozzles is disposed so as to spray the liquid at a specific spray angle with respect to the respective facing side edge.

18 Claims, 29 Drawing Sheets

(56) References Cited

U.S. PATENT DOCUMENTS

| | | | | |
|---|---|---|---|---|
| 6,712,011 | B2 * | 3/2004 | Fumanelli | E05G 1/005 109/20 |
| 8,464,648 | B2 * | 6/2013 | Villiger | E05G 1/14 109/25 |
| 8,555,792 | B2 * | 10/2013 | Berendes | E05G 1/14 109/25 |
| 2004/0154500 | A1 * | 8/2004 | Richard | E05G 1/005 109/25 |
| 2015/0000230 | A1 * | 1/2015 | Wright | B65B 5/067 53/459 |

* cited by examiner

MEDIUM HANDLING DEVICE

TECHNICAL FIELD

This application claims priority from Japanese Patent Application No. 2014-219850, filed Oct. 29, 2014, the disclosure of which is incorporated in its entirety by reference herein.

The present invention relates to a medium handling device including a liquid spraying mechanism that sprays liquid to stain a medium when criminal activity such as a break-in or theft (an emergency) has occurred.

BACKGROUND ART

There are conventional cash handling devices that handle cash as a type of medium handling device that handles a medium. Cash handling devices are given functionality to spray liquid at a medium (banknotes) to stain the medium when criminal activity (an emergency) has occurred, in which the cash handling device has been broken into and the medium (banknotes) stored inside stolen. Note that "stain" refers to a state in which liquid has penetrated into the medium. This functionality is realized by providing a liquid spraying mechanism to a medium storage box stored inside a device, for example (see, for example, Japanese Patent Application Laid-Open (JP-A) Nos. 2010-55134 and 2011-224566).

The medium storage box is a component inside which the medium is stored. The medium storage box is often configured as a unit that is capable of being attached and removed from the device, so as to enable transportation in a state removed from the device. The medium storage box is often configured such that the medium is stored in a state stacked in the vertical direction (a stacked-layer state).

Supposing a criminal activity (an emergency) has occurred, the liquid spraying mechanism stains the medium stored inside the medium storage box, placing the medium in a state hindering usage. The liquid spraying mechanism thereby prevents the stolen medium from being used. Moreover, if the stolen medium were to be used, the liquid spraying mechanism facilitates discovery that the stolen medium has been used, facilitates identification of the person that used the stolen medium, and also suppresses a recurrence of criminal activity (emergencies).

SUMMARY OF INVENTION

Technical Problem

As explained below, there are issues for medium handling devices including a conventional liquid spraying mechanism in that: (1) preferably a stained surface area of each medium stacked in the vertical direction should be increased; and (2) preferably all media stacked in the vertical direction should be stained over a wide range.

Issue 1

Medium handling devices including a conventional liquid spraying mechanism have been intended to be used in relatively safe countries. Even supposing the above-described criminal activity (emergency) had occurred, it has been sufficient as long as medium handling devices including a conventional liquid spraying mechanism could stain all the media stored inside the medium storage box to a certain extent, placing each sheet in a state hindering usage. Thus, medium handling devices including a conventional liquid spraying mechanism only spray liquid at the medium, and are not always configured with the intention of achieving a specific stained surface area or above for each and every sheet of medium. Thus, there may be sheets of medium that are only stained over a small surface area present amongst the medium stained by medium handling devices including a conventional liquid spraying mechanism.

However, there may be countries with unstable public order where the above-described criminal activity (emergency) frequently occurs. There is a possibility of the stolen medium being used in such countries when the stained surface area of the stolen medium is small. Thus, the stained surface area of each medium stacked in the vertical direction is preferably a specific surface area or greater in such countries.

Thus, the stained surface area of each medium stacked in the vertical direction is preferably increased in cases in which a medium handling device including a conventional liquid spraying mechanism is intended to be used in countries with unstable public order.

Issue 2

In general, when liquid is sprayed at stacked medium in which multiple sheets of medium are stacked in the vertical direction, the stained surface area of each medium in an intermediate layer tends to be narrower than the stained surface area of each medium in the lower layer and the upper layer. This tendency occurs due to the following principle.

For example, due to each medium in the intermediate layer and the lower layer of the stacked medium being stacked such that multiple sheets of medium are superimposed on top of each other, each medium is influenced by the weight of other sheets of medium, resulting in a closely contacted state. Thus, each medium in the intermediate layer and the lower layer is in a state in which there are no gaps to the other sheets of medium. In other words, a state results in which wall faces are formed by side edges of each medium in the intermediate layer and the lower layer. Thus, supposing each medium in the intermediate layer and the lower layer is sprayed with liquid, the wall faces formed by the side edges of each medium repel this liquid. This results in a state in which it is difficult for the liquid to penetrate into each of the superimposed medium.

However, the liquid that has been repelled by the wall faces of each medium in the upper layer and intermediate layer falls due to gravity and collects at lower portion inside the medium storage box. Thus, each medium in the lower layer is stained by the liquid falling from above in addition to the liquid sprayed from the liquid spraying mechanism. The liquid thereby penetrates into each medium in the lower layer. Accordingly, the stained surface area of each medium in the lower layer tends to be wider than the stained surface area of each medium in the intermediate layer.

Only a small number of sheets of medium are superimposed on each other for each medium in the upper layer of the stacked medium, and therefore the influence of the weight of other sheets of medium is small, resulting in a not particularly closely contacted state. Thus, although wall faces are also formed by the side edges of each medium in the upper layer, a state results in which there are gaps to other sheets of medium. Thus, supposing each medium in the upper layer has been sprayed with liquid, there is only a small amount of liquid repelled at the wall faces, resulting in a state which the liquid easily penetrates into each of the superimposed medium. Thus, the stained surface area of each medium in the upper layer tends to be wider than the stained surface area of each medium in the intermediate layer.

The stained surface area of each medium in the lower layer is wider than the stained surface area of each medium in the intermediate layer due to the above principle. The stained surface area of each medium in the upper layer is also wider than the stained surface area of each medium in the intermediate layer. Thus, the stained surface area of each medium in the intermediate layer tends to be narrower than the stained surface area of each medium in the lower layer and the upper layer.

Medium handling devices including a conventional liquid spraying mechanism have not been configured taking into consideration the difficulty liquid has in penetrating into each medium in the intermediate layer. Thus, there are cases in which medium handling devices including a conventional liquid spraying mechanism may not always stain all the media stacked in the vertical direction (each medium in the intermediate layer in particular) over a wide range.

In consideration of the above issues, the present invention provides a medium handling device including a liquid spraying mechanism capable of increasing a stained surface area of each medium stacked in the vertical direction, and of enabling all media to be stained over a wide range.

Solution to Problem

An aspect of the present invention is a medium handling device that handles a medium, the medium handling device including a stage on which a rectangular shaped medium is stacked in a vertical direction; and a liquid spraying mechanism including plural liquid spray nozzles that extend along the vertical direction and that spray a liquid at a medium stacked on an upper face of the stage, wherein the liquid spray nozzles being respectively provided at positions facing at least three side edges of the stacked medium, and each of the plural liquid spray nozzles being disposed so as to spray the liquid at a specific spray angle with respect to the respective facing side edge.

The medium handling device sprays liquid at the specific spray angle onto at least three side edges of the stacked medium. The medium handling device thereby enables liquid to be directly sprayed over a wide range onto the at least three side edges of the stacked medium. Even at locations onto which liquid is not directly sprayed, the medium handling device utilizes liquid flow to carry liquid around to these locations. Thus, the medium handling device enables a stained surface area of each medium stacked in the vertical direction to be increased, and enables all media to be stained over a wide range.

Effects of Invention

The present aspect enables the stained surface area of each medium stacked in the vertical direction to be increased, and enables all media to be stained over a wide range.

DESCRIPTION OF EMBODIMENTS

Figure 1:
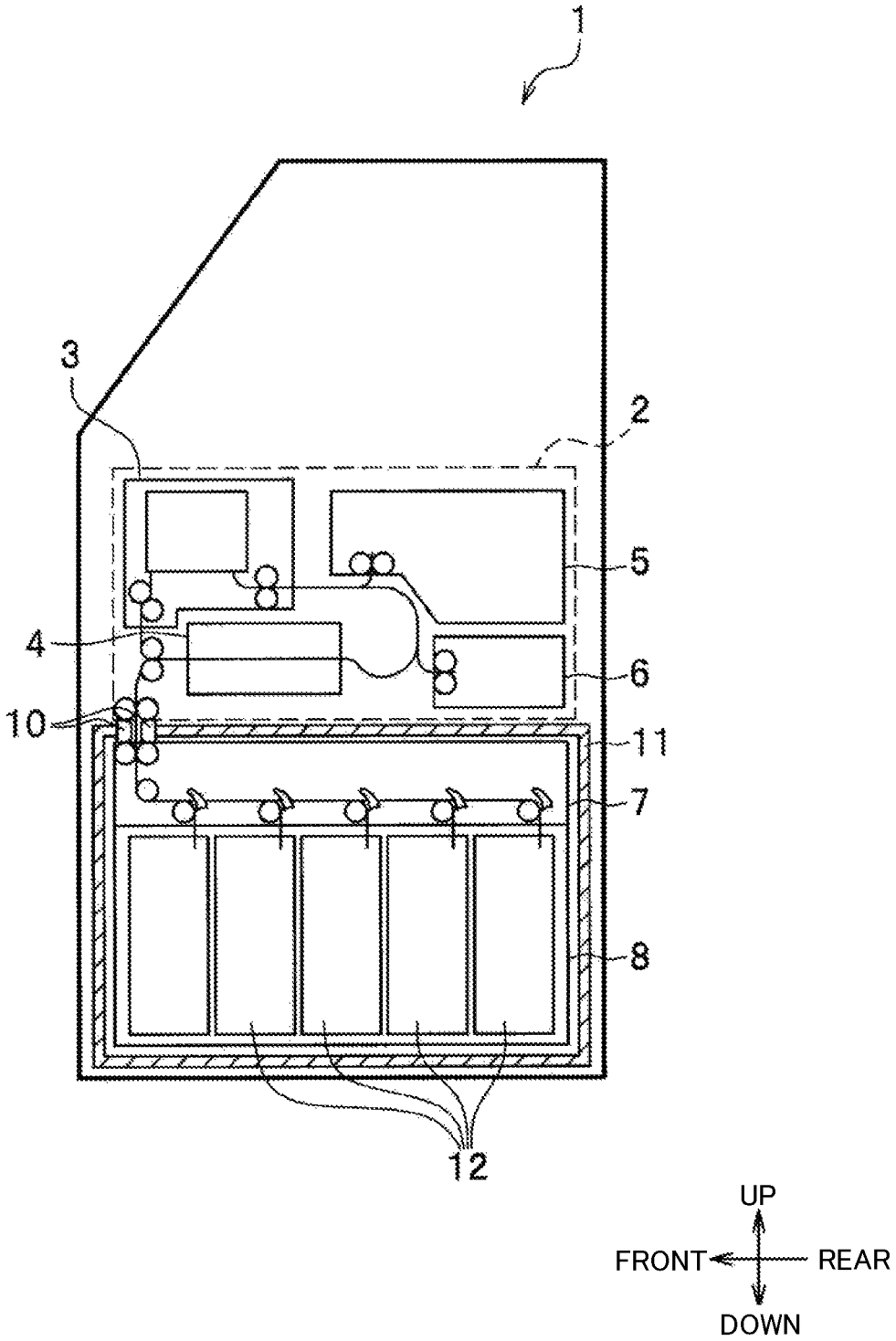
FIG. 1 is a drawing schematically illustrating a configuration of a cash handling device applied with a liquid spraying mechanism according to a first exemplary embodiment.

Detailed explanation follows regarding exemplary embodiments of the present invention (hereafter simply referred to "exemplary embodiments"), with reference to the drawings. Note that each of the drawings is merely an outline illustration to enable sufficient understanding of the present disclosure. Thus, the present disclosure is not limited to the illustrated examples. In each of the drawings, common components and similar components are appended with the same reference numerals, and duplicate explanation thereof is omitted.

First Exemplary Embodiment

Configuration of Liquid Spraying Mechanism

Figure 2:
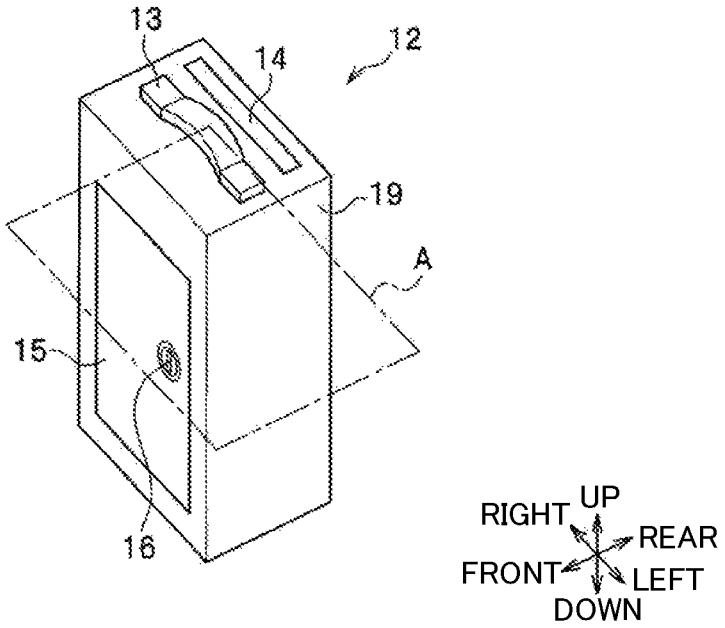
FIG. 2 is a drawing illustrating a configuration of a unit (medium storage box) provided with a liquid spraying mechanism according to the first exemplary embodiment.
Figure 3:
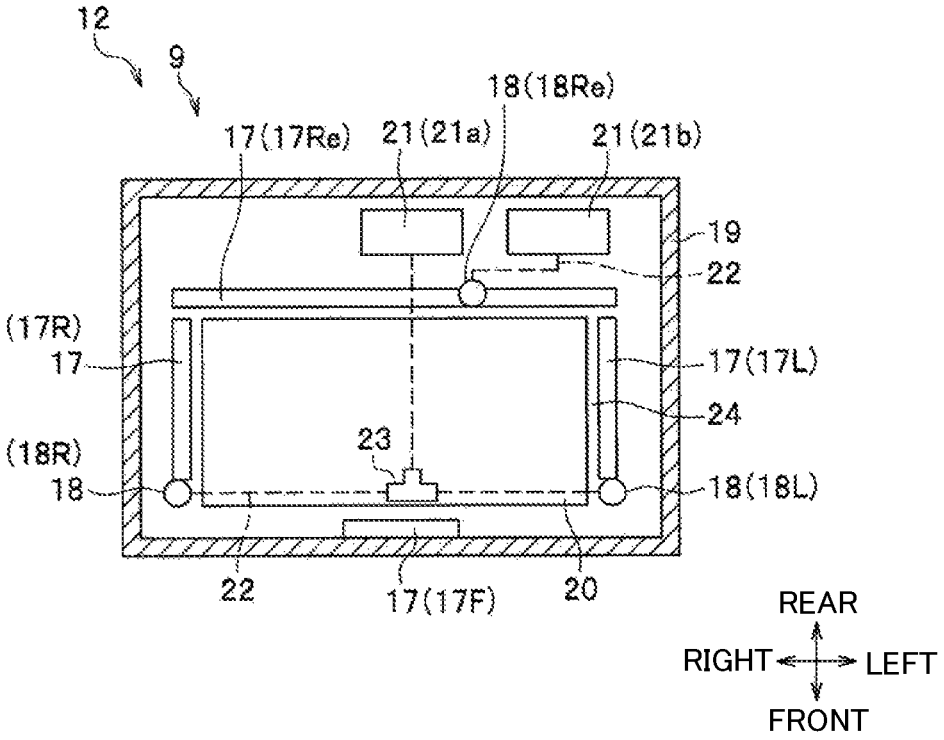
FIG. 3 is a drawing schematically illustrating a configuration of the liquid spraying mechanism according to the first exemplary embodiment.
Figure 4:
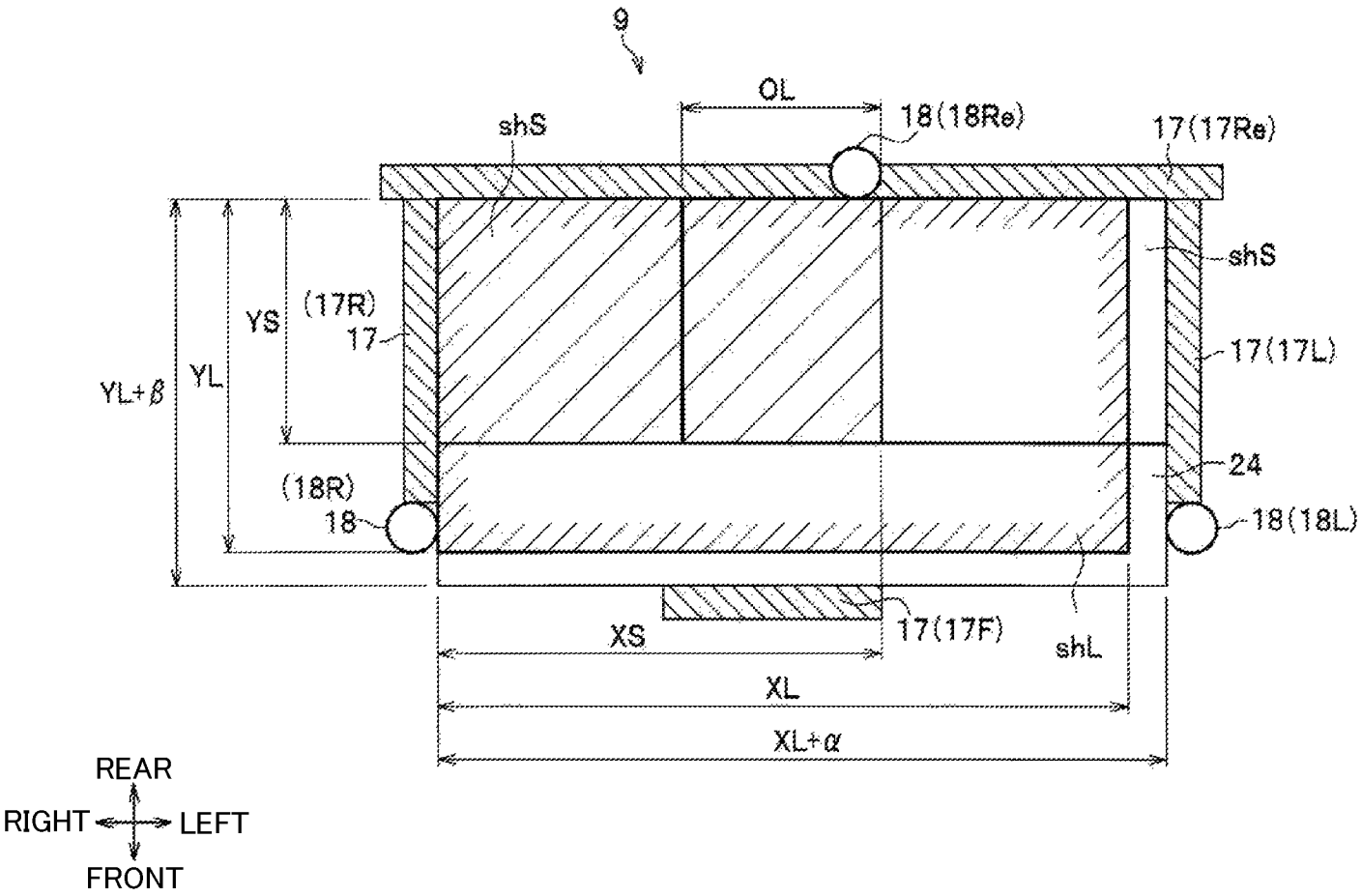
FIG. 4 is a drawing illustrating positions of liquid spray nozzles of the liquid spraying mechanism according to the first exemplary embodiment.
Figure 5:
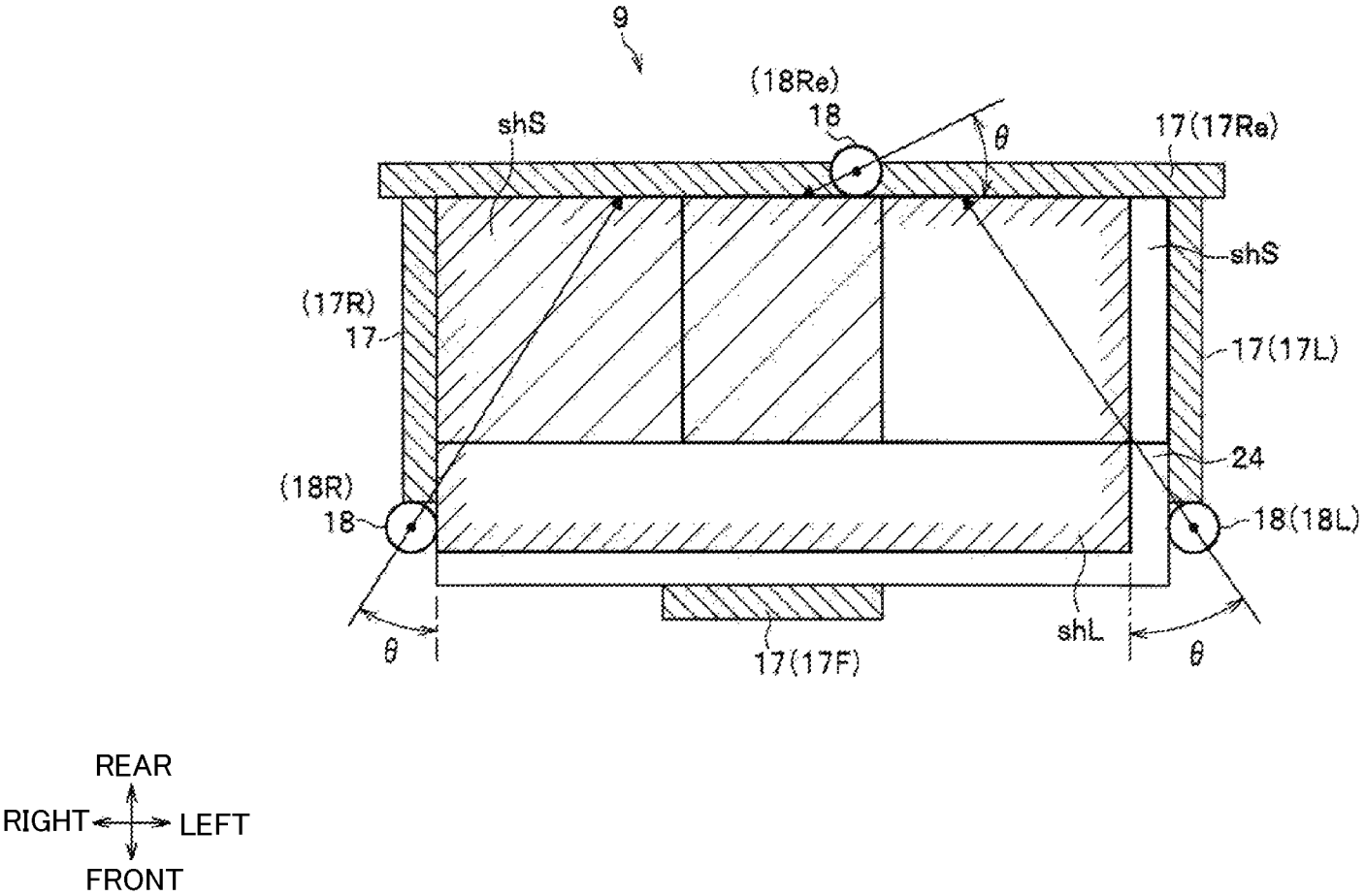
FIG. 5 is a drawing illustrating spray directions of the liquid spraying mechanism according to the first exemplary embodiment.

Explanation follows regarding a configuration of a medium handling device including a liquid spraying mechanism according to the first exemplary embodiment, with reference to FIG. 1 to FIG. 5. FIG. 1 is a drawing schematically illustrating a configuration of a cash handling device applied with the liquid spraying mechanism according to the first exemplary embodiment. FIG. 2 is a drawing illustrating a configuration of a unit (medium storage box) provided with the liquid spraying mechanism according to the first exemplary embodiment. FIG. 3 is a drawing schematically illustrating a configuration of the liquid spraying mechanism according to the first exemplary embodiment. FIG. 4 is a drawing illustrating positions of liquid spray nozzles of the liquid spraying mechanism according to the first exemplary embodiment. FIG. 5 is a drawing illustrating spray directions of the liquid spray nozzles of the liquid spraying mechanism according to the first exemplary embodiment.

Note that explanation follows envisaging a case in which the device to which the liquid spraying mechanism is applied is a cash handling device, the medium is banknotes, and the liquid is ink. The liquid sprayed by the liquid spraying mechanism is hereafter simply referred to as "ink". The cash handling device may be an automatic teller machine (ATM) or a cash dispenser (CD), for example.

Configuration of Cash Handling Device Applied with Liquid Spraying Mechanism

Explanation follows regarding a configuration of a cash handling device 1 applied with a liquid spraying mechanism 9 (see FIG. 3) according to the first exemplary embodiment, with reference to FIG. 1.

As illustrated in FIG. 1, the cash handling device 1 includes a customer interface 3, a classification section 4, a temporary holding section 5, a rejection box 6, a sorting conveyance section 7, and medium storage boxes 12.

The customer interface 3 is a component that takes in the medium (banknotes) to the device interior and discharges the medium to the device exterior. The classification section 4 is a component that classifies the denomination, authenticity, and so on of the medium. The temporary holding section 5 is a location that temporarily holds the medium. The rejection box 6 is a storage box that stores non-reusable medium. The sorting conveyance section 7 is a mechanism that conveys while sorting the medium into a given medium storage box 12. The medium storage boxes 12 are storage boxes that store reusable medium. The medium storage boxes 12 are configured as units capable of being installed in and removed from the cash handling device 1.

The cash handling device 1 also includes a non-illustrated break-in detector and a non-illustrated controller. In cases in which the cash handling device 1 has been broken into, the non-illustrated break-in detector detects the break-in, and outputs a break-in detection signal to the controller of the cash handling device 1. In response to this, the controller of the cash handling device 1 outputs an ink spray command to a non-illustrated liquid spray controller, described later, provided inside the liquid spraying mechanism 9.

Main functions of the cash handling device 1 are divided into an upper unit 2 that takes in the medium to the device interior and discharges the medium to the device exterior, and a lower unit 8 that houses the medium storage boxes 12. The customer interface 3, the classification section 4, the temporary holding section 5, and the rejection box 6 are provided in the upper unit 2. The sorting conveyance section 7 and the medium storage boxes 12 are provided in the lower unit 8.

An exchange guide 10 is provided between the upper unit 2 and the lower unit 8. The exchange guide 10 is a component that guides the exchange of medium between the upper unit 2 and the lower unit 8.

In this configuration of the cash handling device 1, the periphery of the medium storage boxes 12 is covered by a sturdy safe 11 so as to prevent illicit activity with the medium storage boxes 12. However, there is still a possibility of the cash handling device 1 being broken into and the medium storage boxes 12 being stolen. Thus, the liquid spraying mechanism 9 (see FIG. 3) is provided to each medium storage box 12.

The liquid spraying mechanism 9 is a mechanism that sprays ink onto the medium (banknotes) stored inside the medium storage box 12 so as to stain the medium when the occurrence of criminal activity (emergency), such as the cash handling device 1 being broken into, is detected. The liquid spraying mechanism 9 places the medium in a state hindering usage by staining the medium when an emergency has occurred. Thus, the liquid spraying mechanism 9 prevents the stolen medium from being used. The liquid spraying mechanism 9 also facilitates, in a case in which the stolen medium were used, discovery that the stolen medium has been used, facilitates identification of the person who used the stolen medium, and suppresses reoccurrence of the criminal activity (the emergency).

Configuration of Medium Storage Box

Explanation follows regarding a configuration of each medium storage box 12 provided with the liquid spraying mechanism 9 (see FIG. 3), with reference to FIG. 2. FIG. 2 illustrates a configuration of a face-on side of the medium storage box 12, as viewed obliquely from the upper left direction.

As illustrated in FIG. 2, the medium storage box 12 includes a handle 13, a door 15, and a lock 16. The handle 13 is a component that is gripped by a person during transportation. The door 15 is a mechanism that selectively places the interior space in an open state or a closed state. The lock 16 is a mechanism that fixes the door 15.

A medium through-port 14 is formed in the vicinity of the handle 13 on a top plate of the medium storage box 12. The medium through-port 14 is an opening for taking in the medium to the storage box interior and discharging the medium to the storage box exterior. The medium through-port 14 has a shutter structure. The shutter places the medium through-port 14 in a closed state in a state in which the medium storage box 12 has been detached from the cash handling device 1, such as when transporting the medium storage box 12. The shutter places the medium through-port 14 in an open state in a state in which the medium storage box 12 is installed in the cash handling device 1, such as when the cash handling device 1 is in operation.

An outer profile of the medium storage box 12 is substantially cuboid in shape. The medium storage box 12 is configured so as to store multiple sheets of rectangular shaped medium (banknotes) in a state stacked in the vertical direction (a stacked-layer state) in the space inside the door 15.

The medium storage box 12 includes the non-illustrated liquid spray controller and non-illustrated pressurizing mechanisms. The non-illustrated liquid spray controller actuates the pressurizing mechanisms on receiving an ink spray command from the non-illustrated controller of the cash handling device 1. The non-illustrated pressurizing mechanisms pressurize ink stored in liquid tanks 21 (see FIG. 3), described below, and feeds ink from the liquid tanks 21 to pipes 22 (see FIG. 3), described below.

Configuration of Liquid Spraying Mechanism

Explanation follows regarding a configuration of the liquid spraying mechanism 9, with reference to FIG. 3. FIG. 3 is a cross-section of the medium storage box 12 sectioned along the planar face A illustrated in FIG. 2, and illustrates the configuration as viewed from above.

Note that, when distinguishing between components disposed on the front, rear, left, and right in the same components explained below, "F" is appended to the reference numeral of the component disposed at the front, "Re" is appended to the reference numeral of the component disposed at the rear, "R" is appended to the reference numeral of the component disposed on the right, and "L" is appended to the reference numeral of the component disposed on the left.

As illustrated in FIG. 3, the medium storage box 12 includes guide members 17, liquid spray nozzles 18, a stage 20, the liquid tanks (ink tanks) 21, the pipes 22, and a liquid branching member 23, at the interior of casing 19.

The guide members 17 are members that abut side edges of each medium stacked on an upper face of the stage 20. The liquid spray nozzles 18 are nozzles that spray ink. The stage 20 is a member with the medium stacked on its upper face. The liquid tanks (ink tanks) 21 are storage sections in which ink is stored in advance. The pipes 22 are liquid delivery members inside which ink flows and is delivered to the respective sections. The liquid branching member 23 is a member that branches the flow direction of the ink.

As viewed from above, a cross-section profile of the casing 19 of the medium storage box 12 has a rectangular shape with its length direction along the left-right direction and its width direction along the front-rear direction.

The stage 20 is disposed inside the medium storage box 12 at a position behind the door 15 (see FIG. 2). As viewed from above, the shape of the stage 20 is a rectangular shape with its length direction along the left-right direction and its width direction along the front-rear direction. The upper face of the stage 20 is formed in a flat face shape, and the medium is stacked thereon. The stage 20 is configured so as to capable of being moved in the vertical direction by a non-illustrated drive unit, and the upper face of the stage 20 is lowered as the medium is stacked thereon.

The four guide members 17 are disposed at the periphery of the stage 20. Specifically, the guide member 17F is disposed in front of the stage 20, the guide member 17Re is disposed at the rear of the stage 20, the guide member 17R is disposed on the right of the stage 20, and the guide member 17L is disposed on the left of the stage 20.

Thus, the guide members 17F, 17Re face length direction side edges of the stage 20 (namely, length direction side edges of the medium stacked on the upper face of the stage 20). The guide members 17R, 17L face width direction side edges of the stage 20 (namely, width direction side edges of the medium stacked on the upper face of the stage 20). The guide members 17F, 17Re correspond to "length direction guide members". The guide members 17R, 17L correspond to "width direction guide members".

An inner wall face of each guide member 17 that faces the stage 20 is formed in a flat face shape. The inner wall faces abut the side edges of the medium when the medium is stacked on the upper face of the stage 20, and function as guide faces that arrange the medium. The inner wall face (guide face) of each guide member 17 is disposed so as to extend along the vertical direction (perpendicular direction).

Among the four guide members 17F, 17Re, 17R, and 17L, the rear guide member 17Re is fixed and arranged at a specific position inside the casing 19. Thus, the guide member 17Re functions as a reference member for stacking the medium at a specific position in the front-rear direction when stacking the medium onto the upper face of the stage 20.

The other guide members 17F, 17R, and 17L are each configured capable of moving in a direction toward, and a direction away from, the respective opposing side edge of the stage 20. The medium storage box 12 is configured capable of stacking the medium in a space 24 surrounded by the four guide members 17F, 17Re, 17R, and 17L. The space 24 is referred to below as "stackable space 24". The stackable space 24 is at its largest when the guide members 17F, 17R, and 17L have been moved furthest toward the outside (when moved in directions away from the side edges of the stage 20).

Note that the front guide member 17F is provided at a back side of the door 15 (see FIG. 2). The door 15 may be configured such that the door 15 itself serves as the front guide member 17F. The door 15 may also be configured including a bill stopper.

Three or more of the liquid spray nozzles 18 are provided at the periphery of the stage 20 so as to face at least three side edges of the medium stacked on the upper face of the stage 20, with a ratio of 1 to 1, or n to 1 (where n is an integer of two or more). Explanation follows in which the three liquid spray nozzles 18 are disposed so as to extend along the vertical direction at the periphery of the stage 20. Specifically, explanation follows in which the liquid spray nozzle 18Re is disposed at the rear of the stage 20, the liquid spray nozzle 18R is disposed on the right of the stage 20, and the liquid spray nozzle 18L is disposed on the left of the stage 20.

Thus, the liquid spray nozzle 18Re faces a length direction side edge of the stage 20 (namely, a length direction side edge of the medium stacked on the upper face of the stage 20). The liquid spray nozzles 18R, 18L face the width direction side edges of the stage 20 (namely, the width direction side edges of the medium stacked on the upper face of the stage 20). The liquid spray nozzle 18Re corresponds to a "length direction nozzle". The liquid spray nozzles 18R, 18L correspond to "width direction nozzles". In the example illustrated in FIG. 3, there are one of each of the liquid spray nozzles 18Re, 18R, and 18L; however, there may be respectively plural of each. Each liquid spray nozzle 18 may be configured of either a metal material or a resin material.

The liquid spray nozzle 18Re of the present exemplary embodiment is disposed in a position slightly to the left of a center portion of the length direction side edge of the stage 20 (namely, the length direction side edge of the medium stacked on the upper face of the stage 20). Non-illustrated liquid spray holes of the liquid spray nozzle 18Re are disposed in a state inclined at a specific angle with respect to the length direction side edge, such that ink is sprayed from this position toward the center portion of the length direction side edge of the stage 20.

However, as long as the position is within a range OL (see FIG. 4), described later, the liquid spray nozzle 18Re may be disposed at a position slightly to the right of the center portion of the length direction side edge of the stage 20, and the non-illustrated liquid spray holes may be disposed such that ink is sprayed from this position toward the center portion of the length direction side edge of the stage 20.

The liquid spray nozzles 18R, 18L are disposed at positions separated from the length direction side edge on the opposite side of center portions of the width direction side edges of the stage 20 to the length direction side edge facing the liquid spray nozzle 18Re. Non-illustrated liquid spray holes of the liquid spray nozzles 18R, 18L are disposed in a state inclined at a specific angle with respect to the length direction side edges, such that ink is sprayed from these positions toward the respective length direction side edge of the stage 20.

Each liquid spray nozzle 18 includes plural liquid spray holes that spray ink. The liquid spray holes of each of the respective liquid spray nozzles 18 are disposed so that together they span the entire area of the stackable space 24 in vertical direction (height direction), so as to face each medium from an uppermost layer to a lowermost layer stacked inside the stackable space 24. The liquid spray nozzles 18 spray ink fed out from the liquid tanks 21 through the liquid spray holes toward the medium when an emergency has occurred.

In the first exemplary embodiment, two liquid tanks 21 are disposed at the rear of the guide member 17Re. Reference is made to a "liquid tank 21*a*" and a "liquid tank 21*b*" when distinguishing between each liquid tank 21 below.

The pipes 22 couple the liquid tank 21*a* and the liquid spray nozzles 18R, 18L together through the liquid branching member 23. The pipes 22 also couple the liquid tank 21*b* and the liquid spray nozzle 18Re together. The pipes 22 may be configured of either a metal material or a resin material.

The respective liquid tanks 21*a*, 21*b* feed out ink to the pipes 22 when an emergency has occurred. The fed-out ink flows inside the pipes 22. When this occurs, the liquid branching member 23 branches the flow direction of ink fed out from the liquid tank 21*a* toward the right liquid spray nozzle 18R, and toward the left liquid spray nozzle 18L.

The liquid branching member 23 is provided in a position such that distances to the two liquid spray nozzles 18 (the liquid spray nozzles 18R, 18L in this case) disposed facing each other on one side and another side of the medium are equidistant. Namely, the liquid branching member 23 is disposed at a position at which the distance from the liquid branching member 23 to the liquid spray nozzle 18R, and the distance from the liquid branching member 23 to the liquid spray nozzle 18L, are the same.

Thus, the liquid spraying mechanism 9 adjusts the ink spray amount such that the liquid spray nozzle 18 on the one side (the right liquid spray nozzle 18R in this case) and the liquid spray nozzle 18 on the other side (the left liquid spray nozzle 18L in this case), which share ink stored in the liquid tank 21*a*, have substantially the same ink spray amount.

Note that the liquid branching member 23 may be disposed in such a position even in cases provided with the same number on each side for two or more liquid spray nozzles 18 on the one side (right liquid spray nozzles 18R in this case) and two or more liquid spray nozzles 18 on the other side (left liquid spray nozzles 18L in this case).

Positions and Spray Directions of Liquid Spray Nozzles

Explanation follows regarding the positions and spray directions of the liquid spray nozzles 18, with reference to FIG. 4 and FIG. 5.

As illustrated in FIG. 4, both a maximum size medium shL and a minimum size medium shS may be stacked in the stackable space 24. Note that the "maximum size medium shL" indicates the maximum size of banknote of banknote denominations capable of being handled by the device. The "minimum size medium shS" indicates the minimum size of banknote of banknote denominations capable of being handled by the device.

FIG. 4 illustrates examples of the following states (a) to (c).

(a) is a state in which the maximum size medium shL is right-aligned (namely, a state in which the maximum size medium shL abuts the rear guide member 17Re and the right guide member 17R).

(b) is a state in which the minimum size medium shS is right-aligned (namely, a state in which the minimum size medium shS abuts the rear guide member 17Re and the right guide member 17R).

(c) is a state in which the minimum size medium shS is left-aligned (namely, a state in which the minimum size medium shS abuts the rear guide member 17Re and the left guide member 17L).

In the example illustrated in FIG. 4, the dimensions of the maximum size medium shL are such that XL is the length of length direction side edges and YL is the width of width direction side edges. The dimensions of the minimum size medium shS are such that XS is the length of length direction side edges and YS is the width of width direction side edges. The dimensions of the stackable space 24 are such that (XL+α) is the length of length direction side edges and (YL+β) is the width of width direction side edges. "α" and "β" are freely set values from several mm to several tens of mm.

The rear liquid spray nozzle 18Re is disposed at a position at the rear of the guide member 17Re and at a position inside the range OL, wherein "OL" is a range where the length direction side edges of the minimum size medium shS in the state (b) and the minimum size medium shS in the state (c) overlap with each other. Plural liquid spray nozzles 18Re may be provided at positions inside the range OL.

Note that the reason why the liquid spray nozzle 18Re is disposed in a position inside the range OL is because the minimum size medium shS may either be in the state (b) or the state (c) depending on operation by a user, thereby enabling the medium to be excellently stained in either state.

The liquid spraying mechanism 9 is set such that a spray angle θ with respect to the medium is a relatively small value for spraying the ink, thereby enabling the ink to be sprayed over a wide range of the side edges of the medium.

All media stacked in the vertical direction may be particularly excellently stained over a wide range in cases in which the spray angle θ of the liquid spraying mechanism 9 is 45° or smaller.

Explanation follows regarding a relationship between the spray angle θ and an applied surface area, with reference to FIG. 6A to FIG. 6D. FIG. 6A to FIG. 6D are each explanatory drawings of a spray direction of the liquid spraying mechanism 9.

Figure 6A:
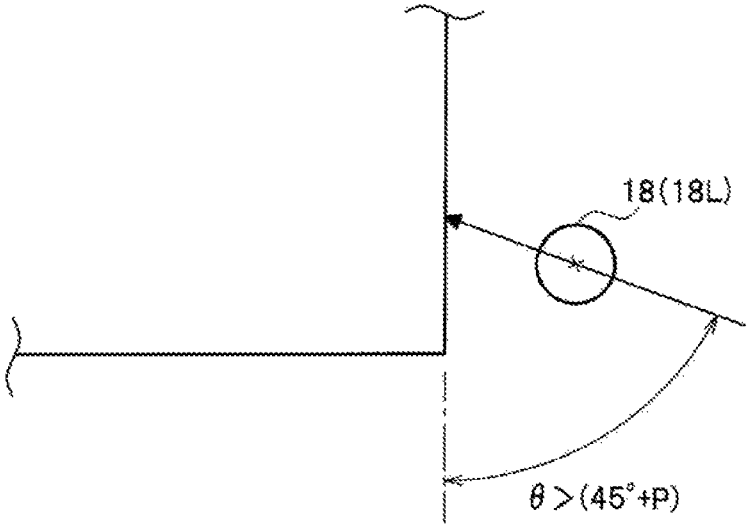
FIG. 6A is an explanatory drawing (1) of a spray direction of the liquid spraying mechanism according to the first exemplary embodiment.
Figure 6B:
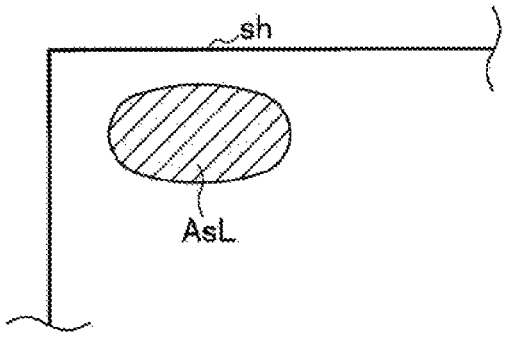
FIG. 6B is an explanatory drawing (2) of a spray direction of the liquid spraying mechanism according to the exemplary embodiment.
Figure 6C:
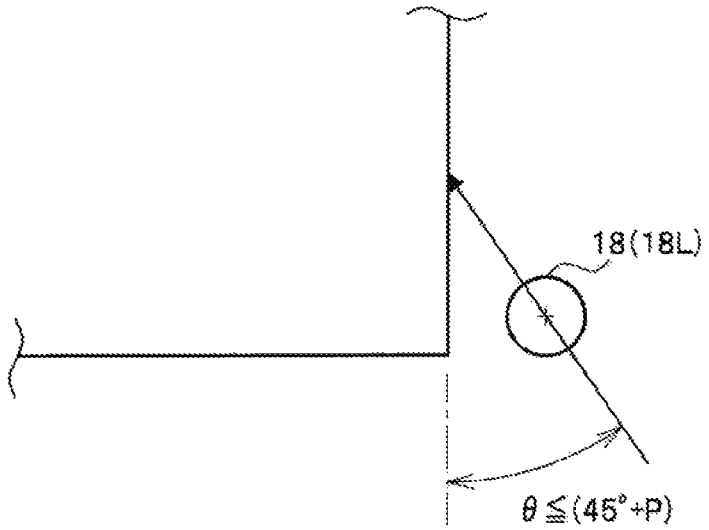
FIG. 6C is an explanatory drawing (3)) of a spray direction of the liquid spraying mechanism according to the first exemplary embodiment.

FIG. 6A illustrates a case in which the spray angle θ0 is larger than (45+P)°, and FIG. 6B illustrates an applied surface area ArL in this case. FIG. 6C illustrates a case in which the spray angle θ is (45+P)° or smaller, and FIG. 6D illustrates an applied surface area ArS in this case.

Figure 6D:
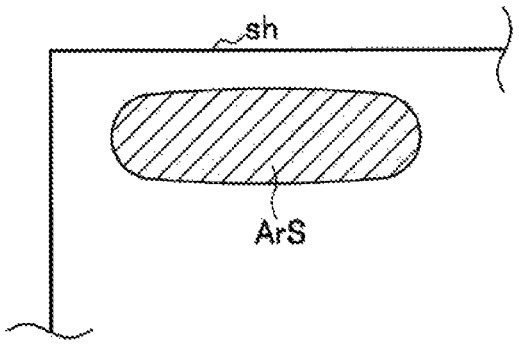
FIG. 6D is an explanatory drawing (4) of a spray direction of the liquid spraying mechanism according to the first exemplary embodiment.

As illustrated in FIG. 6B and FIG. 6D, the applied surface area ArS (see FIG. 6D) is larger in cases in which the spray angle θ is (45+P)° or smaller (see FIG. 6C) than the applied surface area ArL (see FIG. 6B) in cases in which the spray angle θ is larger than (45+P)° (see FIG. 6A). Thus, the applied surface area of the ink may be increased by making the spray angle θ of the liquid spraying mechanism 9 relatively small.

Note that P refers to an acceptable angle with respect to an angle of 45° or smaller, this being a particularly favorable angle. In cases in which the spray angle θ is 45° or smaller, the liquid spraying mechanism 9 is capable of staining all the media stacked in the vertical direction particularly excellently. However, the spray angle θ may be set at a larger value than 45° within the range of the acceptable angle P. Namely, the spray angle θ may be set at a value of (45+P)° or smaller. The value of the acceptable angle P is approximately 15°, for example. Thus, the liquid spraying mechanism 9 is capable of excellently staining all the media stacked in the vertical direction over a wide range as long as the spray angle θ is (45°+15)° or smaller (namely, 60° or smaller).

Note that "all the media" referred to herein indicates any type of medium among the state (a) of the maximum size medium shL (namely, the maximum size medium shL in the right-aligned state), the state (b) of the minimum size medium shS (namely, the minimum size medium shS in the right-aligned state), and the state (c) of the minimum size medium shS (namely, the minimum size medium shS in the left-aligned state), as well as each and every sheet of medium in the stacked medium stacked in the vertical direction.

Operation of Liquid Spraying Mechanism

Explanation follows regarding operation of the liquid spraying mechanism 9, with reference to FIG. 3.

When an emergency has occurred, first, the non-illustrated break-in detector of the cash handling device 1 detects that the cash handling device 1 has been broken into, and outputs a break-in detection signal to the controller of the cash handling device 1. In response to this, the controller of the cash handling device 1 outputs an ink spray command to the non-illustrated liquid spray controller provided inside the liquid spraying mechanism 9.

Note that explanation follows in which the length direction side edges of the plural sheets of medium stacked in the vertical direction (hereafter referred to as "stacked medium") form wall faces (hereafter referred to as "length direction end faces"), and the width direction side edges of the stacked medium form wall faces (hereafter referred to as "width direction end faces".

In response to the ink spray command, the non-illustrated liquid spray controller actuates the non-illustrated pressurizing mechanisms provided at the periphery of the liquid tanks 21*a*, 21*b*. The pressurizing mechanisms pressurize ink stored in the liquid tanks 21*a*, 21*b*, and feed out ink from the liquid tanks 21*a*, 21*b* to the pipes 22.

Ink conveyed from the liquid tank 21*a* flows inside the respective pipe 22, is divided toward the right and left at the liquid branching member 23, and flows toward the right liquid spray nozzle 18R and toward the left liquid spray nozzle 18L. Thus, the liquid spray nozzles 18R, 18L spray ink toward the width direction end faces of the stacked medium.

Ink conveyed from the liquid tank 21*b* flows inside the respective pipe 22, and flows toward the rear liquid spray nozzle 18Re. Thus, the liquid spray nozzle 18Re sprays ink toward the length direction end face of the stacked medium.

Figure 7:
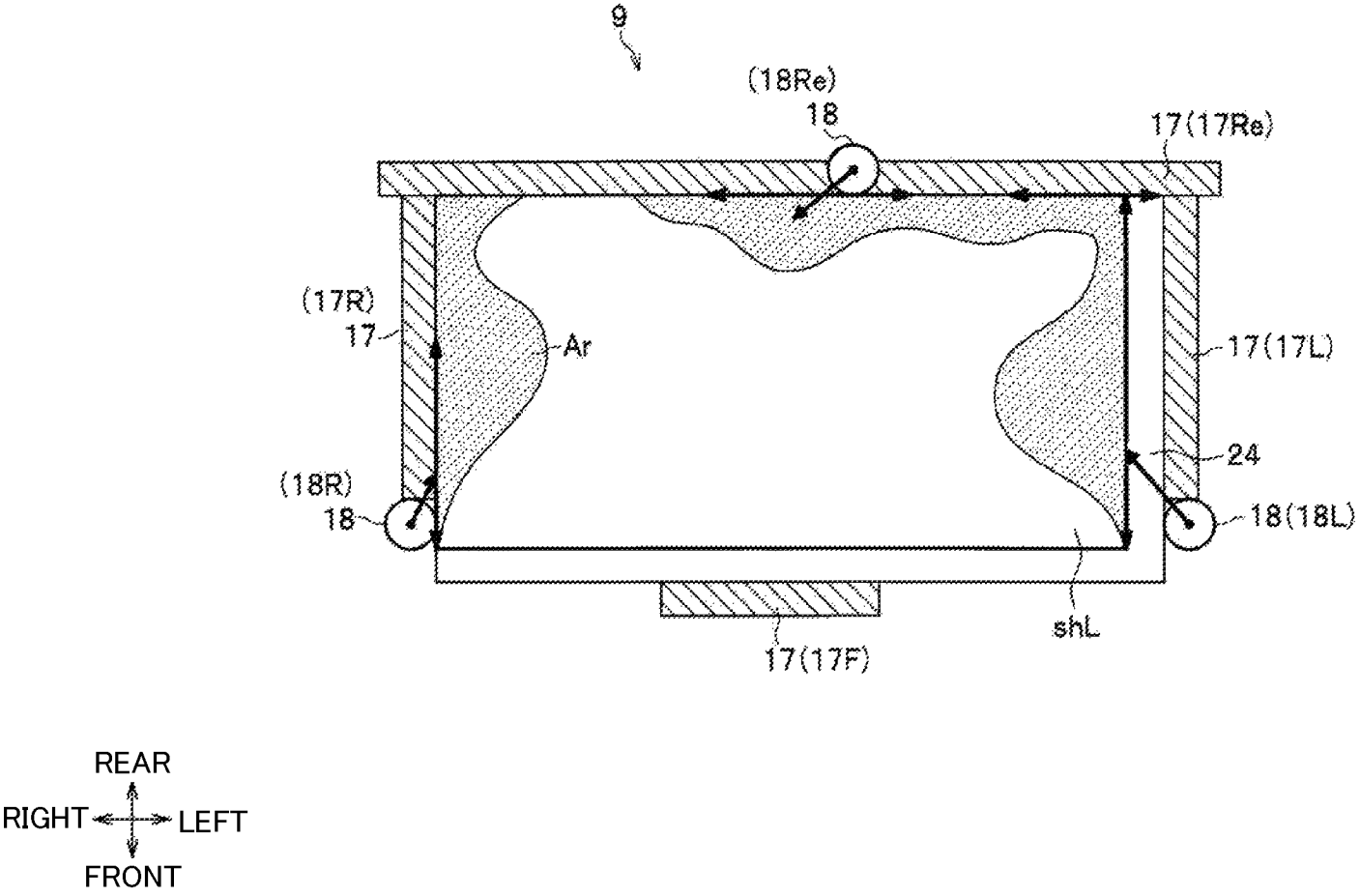
FIG. 7 is a drawing (1) illustrating an example of liquid application by the liquid spraying mechanism according to the first exemplary embodiment.
Figure 8A:
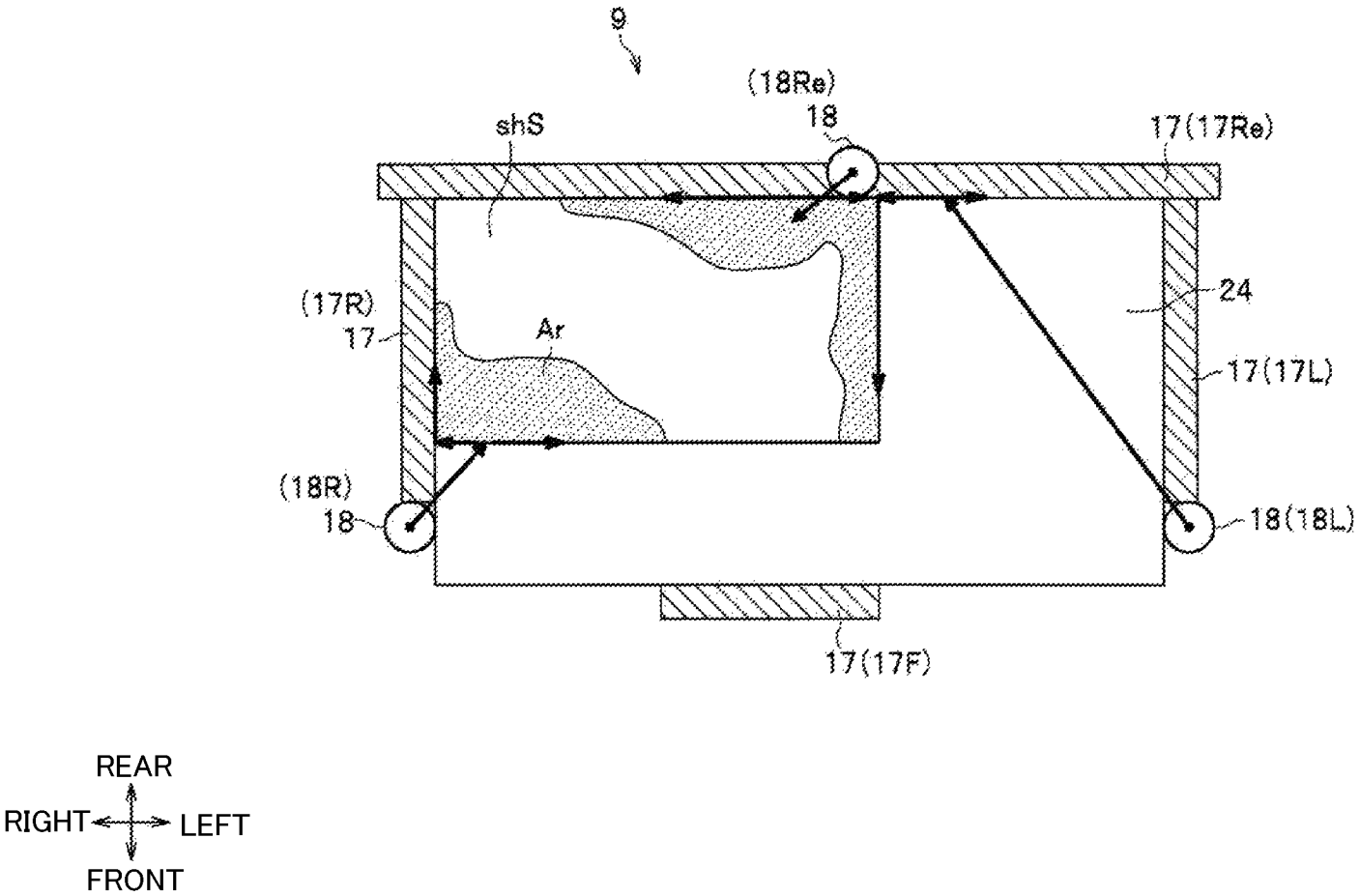
FIG. 8A is a drawing (2) illustrating an example of liquid application by the liquid spraying mechanism according to the first exemplary embodiment.
Figure 8B:
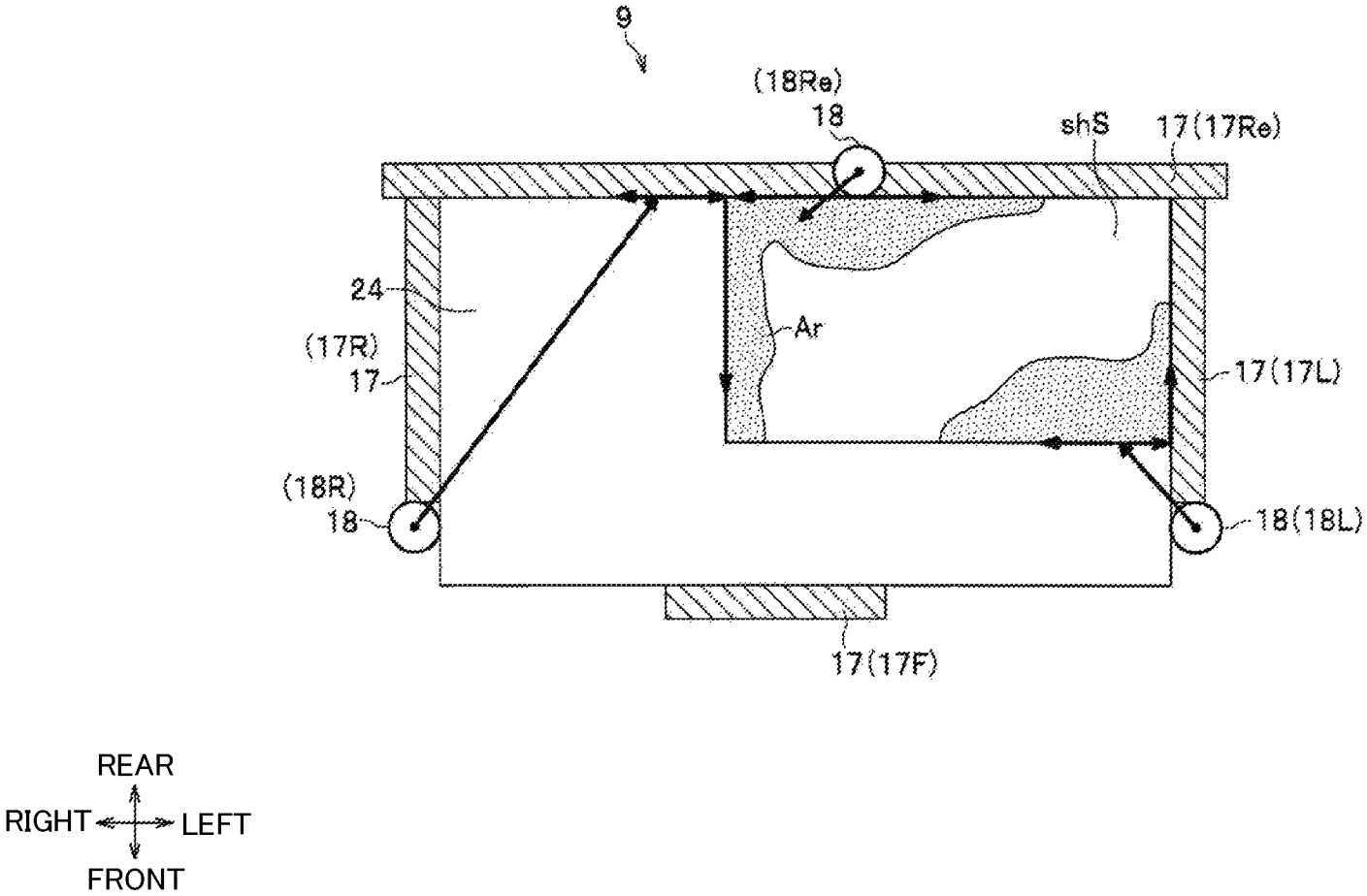
FIG. 8B is a drawing (3) illustrating an example of liquid application by the liquid spraying mechanism according to the first exemplary embodiment.

Thus, as illustrated in FIG. 7, FIG. 8A, and FIG. 8B, ink is applied onto the stacked medium. FIG. 7, FIG. 8A, and FIG. 8B are each drawings illustrating an example of ink application by the liquid spraying mechanism 9. FIG. 7 illustrates an example of ink application in a case in which the maximum size medium shL has been stacked in the stackable space 24 in a right-aligned state. FIG. 8A illustrates an example of ink application in a case in which the minimum size medium shS has been stacked in the stackable space 24 in a right-aligned state. FIG. 8B illustrates an example of ink application in a case in which the minimum size medium shS has been stacked in the stackable space 24 in a left-aligned state.

As illustrated in FIG. 7, in a case in which the maximum size medium shL has been stacked in the stackable space 24 in a right-aligned state, ink sprayed from the right liquid spray nozzle 18R is applied to the right width direction end face of the stacked medium. Thus, most of the ink flows rearward along the right width direction end face of the stacked medium, and some of the ink flows in the opposite direction (forward). Ink sprayed from the left liquid spray nozzle 18L is applied to the left width direction end face of the stacked medium. Thus, most of the ink flows rearward along the left width direction end face of the stacked medium, and some of the ink flows in the opposite direction (forward). Thus, a relatively large amount of ink flows from the right and left to between the rear guide member 17Re and the rear length direction end face of the stacked medium.

Ink sprayed from the rear liquid spray nozzle 18Re is applied to the rear length direction end face of the stacked medium. Thus, most of the ink flows between the rear guide member 17Re and the rear length direction end face of the stacked medium toward the center portion, and some of the ink flows in the opposite direction (an end portion direction).

As illustrated in FIG. 8A, in a case in which the minimum size medium shS has been stacked in the stackable space 24 in a right-aligned state, ink sprayed from the right liquid spray nozzle 18R is applied to the front length direction end face of the stacked medium. Thus, most of the ink flows toward the center portion along the front length direction end face of the stacked medium, and some of the ink flows in the opposite direction (an end portion direction). Ink sprayed from the left liquid spray nozzle 18L is applied to the rear guide member 17Re. Thus, most of the ink flows along the rear guide member 17Re toward the center portion, and some of the ink flows in the opposite direction (an end portion direction). When this occurs, most of the ink is applied to a corner portion between the rear length direction end face and the left width direction end face of the stacked medium, and branches at the corner portion. Thus, some of the ink flows between the rear guide member 17Re and the rear length direction end face of the stacked medium toward the center portion, and some of the ink flows forward between the left guide member 17L and the left width direction end face of the stacked medium.

Ink sprayed from the rear liquid spray nozzle 18Re is applied to the rear length direction end face of the stacked medium. Thus, most of the ink flows between the rear guide member 17Re and the rear length direction end face of the stacked medium toward the center portion, and some of the ink flows in the opposite direction (an end portion direction).

As illustrated in FIG. 8B, in a case in which the minimum size medium shS has been stacked in the stackable space 24 in a left-aligned state, ink sprayed from the right liquid spray nozzle 18R is applied to the rear guide member 17Re. Thus, most of the ink flows along the rear guide member 17Re toward the center portion, and some of the ink flows in the opposite direction (an end portion direction). When this occurs, most of the ink is applied to a corner portion between the rear length direction end face and the right width direction end face of the stacked medium, and branches at the corner portion. Thus, some of the ink flows between the rear guide member 17Re and the rear length direction end face of the stacked medium toward the center portion, and some of the ink flows forward between the left guide member 17L and the left width direction end face of the stacked medium. Ink sprayed from the left liquid spray nozzle 18L is applied to the front length direction end face of the stacked medium. Thus, most of the ink flows along the front length direction end face of the stacked medium toward the center portion, and some of the ink flows in the opposite direction (an end portion direction).

Ink sprayed from the rear liquid spray nozzle 18Re is applied to the rear length direction end face of the stacked medium. Thus, most of the ink flows between the rear guide member 17Re and the rear length direction end face of the stacked medium toward the center portion, and some of the ink flows in the opposite direction (an end portion direction).

Note that in the liquid spraying mechanism 9, the amount of ink stored in the liquid tanks 21 is limited. Thus, the liquid spraying mechanism 9 preferably efficiently stains a wide range of the length direction end faces and the width direction end faces of the stacked medium using a small amount of ink.

When investigating a stained state of the medium, ink sprayed from the liquid spray nozzles 18R, 18L flowed along the width direction end faces of the stacked medium toward the guide member 17Re, and is carried around along the guide member 17Re toward the rear length direction end face of the stacked medium. Thus, the length direction end faces of the stacked medium are more easily stained than the width direction end faces of the stacked medium.

Thus, in the first exemplary embodiment, the liquid spraying mechanism 9 is set such that an ink spray amount from the liquid spray nozzle 18Re is less than an ink spray amount from the liquid spray nozzles 18R, 18L. Thus, the liquid spraying mechanism 9 enables the ink spray amount to be varied across the length direction end faces and the width direction end faces of the stacked medium, and the length direction end faces and the width direction end faces of the stacked medium to be efficiently stained over a wide range using a small amount of ink.

In the first exemplary embodiment, the liquid branching member 23 is disposed in a position such that the distance from the liquid spray nozzle 18R to the liquid branching member 23, and the distance from the liquid spray nozzle 18L to the liquid branching member 23, are the same. Thus, the liquid spraying mechanism 9 enables substantially the same amounts of ink to be sprayed from the right liquid spray nozzle 18R and the left liquid spray nozzle 18L.

Thus, the liquid spraying mechanism 9 is able to respond to either state of the state (b) (the state in which the minimum size medium shS is right-aligned) or the state (c) (the state in which the minimum size medium shS is right-aligned), and to stain the medium excellently.

In the liquid spraying mechanism 9, the right liquid spray nozzle 18R and the left liquid spray nozzle 18L are disposed close to the door 15, and spray ink onto the medium at a spray angle $\theta$ of $(45+P)^\circ$ or smaller. The liquid spraying mechanism 9 thereby enables the following advantageous effects to be obtained.

The liquid spraying mechanism 9 enables ink to be directly sprayed over a wide range of the width direction end faces of the stacked medium. Even in locations where the ink has not been directly sprayed, the liquid spraying mechanism 9 may utilize the fact that ink flows to carry the ink around toward these locations. This enables the liquid spraying mechanism 9 to stain all the media stacked in the vertical direction over a wide range.

This liquid spraying mechanism 9 also enables the amount of wasted ink that does not adhere to the stacked medium to be reduced. Thus, the liquid spraying mechanism 9 enables the end faces of the stacked medium to be efficiently stained over a wide range using a small amount of ink.

As described above, the liquid spraying mechanism 9 according to the first exemplary embodiment enables the stained surface area of each medium stacked in the vertical direction to be increased, and enables all the media to be stained over a wide range.

Second Exemplary Embodiment

An the second exemplary embodiment provides a liquid spraying mechanism 9A in which ink spray amounts of respective liquid spray holes are set at amounts according to the positions in the height direction at which the respective liquid spray holes are disposed.

Figure 9:
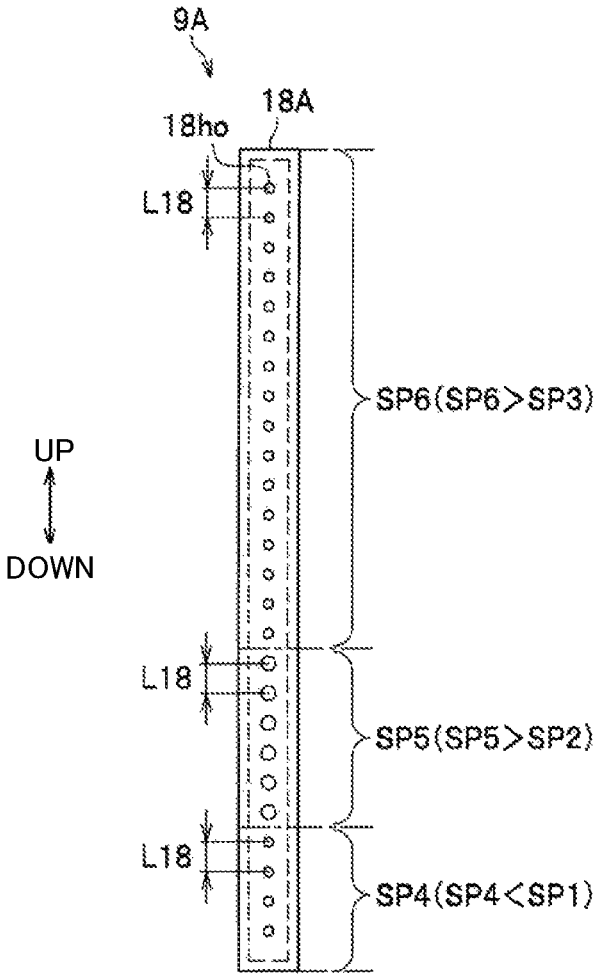
FIG. 9 is a drawing schematically illustrating a configuration of a liquid spray nozzle employed in a liquid spraying mechanism according to a second exemplary embodiment.

Explanation follows regarding a configuration of the liquid spraying mechanism 9A according to the second exemplary embodiment, with reference to FIG. 9. FIG. 9 is a drawing schematically illustrating a configuration of a liquid spray nozzle 18A employed in the liquid spraying mechanism 9A according to the second exemplary embodiment.

As illustrated in FIG. 9, the liquid spraying mechanism 9A according to the second exemplary embodiment is a mechanism with a similar configuration to the liquid spraying mechanism 9 according to the first exemplary embodiment, and employs the liquid spray nozzle 18A as a liquid spray nozzle 18. The liquid spray nozzle 18A is a nozzle in which cross-sectional areas (hole diameter sizes) of liquid spray holes 18*ho* are set with different sizes in steps, according to the height direction positions of the liquid spray holes 18*ho*. The liquid spray nozzle 18A may be configured by either a metal material or a resin material.

In the example illustrated in FIG. 9, the cross-sectional areas (hole diameter sizes) of the liquid spray holes 18*ho* of the liquid spray nozzle 18A are set at different sizes in steps, according to three layers of height direction positions, these being a lower layer 4, an intermediate layer SP5, and an upper layer SP6. In the example illustrated in FIG. 9, all the liquid spray holes 18*ho* are formed with spacings of a distance L18 therebetween. Note that the lower layer SP4, the intermediate layer SP5, and the upper layer SP6 are layers at the same heights as a lower layer SP1, an intermediate layer SP2, and an upper layer SP3 illustrated in FIG. 10A.

Figure 10A:
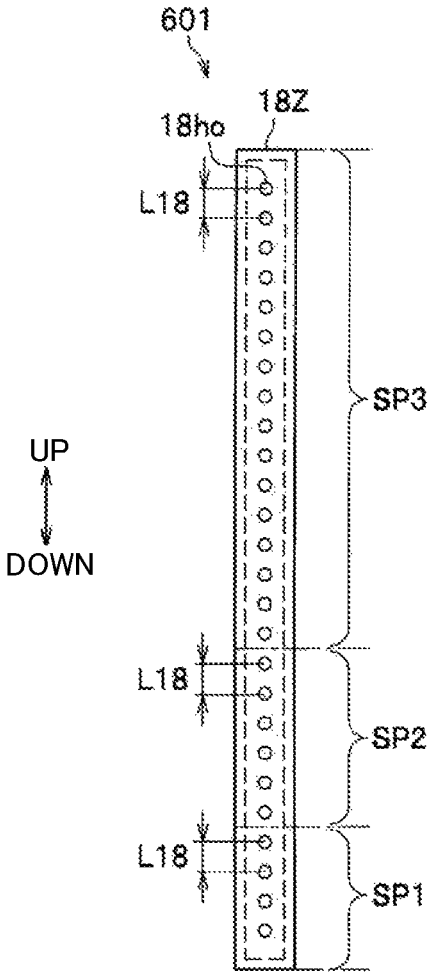
FIG. 10A is a drawing illustrating a configuration of a liquid spray nozzle employed in a liquid spraying mechanism according to a comparative example.
Figure 10B:
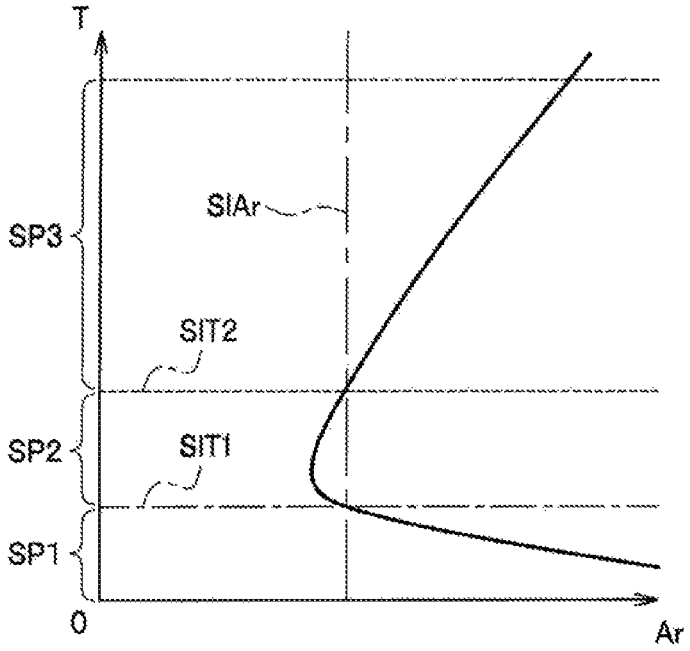
FIG. 10B is a graph illustrating characteristics in the height direction of a stained surface area by the liquid spraying mechanism according to the comparative example.

In order to clearly explain features of the liquid spray nozzle 18A according to the second exemplary embodiment, first, a configuration of a liquid spray nozzle 18Z employed in a liquid spraying mechanism 601 according to a comparative example, and height direction characteristics of a stained surface area by the liquid spraying mechanism 601 according to the comparative example, are explained with reference to FIG. 10A and FIG. 10B. Explanation then follows regarding a comparison between the features of the liquid spray nozzle 18A employed in the liquid spraying mechanism 9A according to the second exemplary embodiment and the characteristics of the liquid spray nozzle 18Z employed in the liquid spraying mechanism 601 according to the comparative example. FIG. 10A is a drawing illustrating a configuration of the liquid spray nozzle 18Z employed in the liquid spraying mechanism 601 according to the comparative example. FIG. 10B is a graph illustrating height direction characteristics of the stained surface area by the liquid spraying mechanism 601 according to the comparative example.

As illustrated in FIG. 10A, the liquid spraying mechanism 601 according to the comparative example has a similar configuration to the liquid spraying mechanism 9 according to the first exemplary embodiment, and is a mechanism that employs the liquid spray nozzle 18Z as a liquid spray nozzle 18. The liquid spray nozzle 18Z is a nozzle in which the cross-sectional areas (hole diameter sizes) of all the liquid spray holes 18*ho* are set at the same size, regardless of the height direction positions of the liquid spray holes 18*ho*. In the example illustrated in FIG. 10A, all the liquid spray holes 18*ho* are formed at spacings with the distance L18 therebetween.

Note that the lower layer SP1, the intermediate layer SP2, and the upper layer SP3 illustrated in FIG. 10A refer to height direction layers that are sectioned at a height S1T1 and a height S1T2 illustrated in FIG. 10B. The heights S1T1, S1T2 indicate heights at boundaries between whether or not the stained surface area becomes wider than a fixed surface area S1Ar (namely, at boundaries between whether or not the medium may be stained excellently).

FIG. 10B illustrates a relationship between height direction positions of each medium and stained surface area when the liquid spraying mechanism 601 according to the comparative example has sprayed ink from the liquid spray nozzle 18Z. Note that FIG. 10B illustrates a relationship in cases in which the liquid spraying mechanism 601 according to the comparative example has sprayed ink from the liquid spray nozzle 18Z in a state in which the inside of the medium storage box 12 is completely filled with the stored medium.

As illustrated in FIG. 10B, in the liquid spraying mechanism 601 according to the comparative example, in the height direction, the stained surface area of each medium in the intermediate layer SP2 (the medium stacked between the height S1T1 and the height S1T2) tends to be narrower than the stained surface area of each medium in the lower layer SP1 and the upper layer SP3 (medium stacked at a lower position than the height S1T1, and medium stacked at a higher position than the height S1T2).

Thus, the second exemplary embodiment provides the liquid spraying mechanism 9A that is capable of increasing the stained surface area of each medium in the intermediate layer SP2.

As described above, the liquid spraying mechanism 9A according to the second exemplary embodiment employs the liquid spray nozzle 18A with the configuration illustrated in FIG. 9 as a liquid spray nozzle 18. The liquid spray nozzle 18A according to the second exemplary embodiment has the same configuration as the liquid spray nozzle 18Z according to the comparative example, except that the cross-sectional areas (hole diameter sizes) of the liquid spray holes 18*ho* are different from each other.

Relationships between the cross-sectional areas (hole diameter sizes) of the liquid spray holes 18*ho* satisfy the following equations (1) to (4).

$$SP4<SP1 \quad (1)$$

$$SP5>SP2 \quad (2)$$

$$SP6<SP3 \quad (3)$$

$$SP6<SP4<SP5 \quad (4)$$

In the above equations (1) to (4), SP1, SP2, and SP3 respectively refer to the cross-sectional areas (hole diameter sizes) of the liquid spray holes 18*ho* in the lower layer, intermediate layer, and upper layer of the liquid spray nozzle 18Z according to the comparative example.

SP4, SP5, and SP6 respectively refer to the cross-sectional areas (hole diameter sizes) of the liquid spray holes 18*ho* in the lower layer, intermediate layer, and upper layer of the liquid spray nozzle 18A according to the second exemplary embodiment.

As is clear from equation (2), the cross-sectional area of the liquid spray holes 18*ho* in the intermediate layer (SP5) of the liquid spray nozzle 18A according to the second exemplary embodiment is set with a larger value than the cross-sectional area of the liquid spray holes 18*ho* in the intermediate layer (SP2) of the liquid spray nozzle 18Z according to the comparative example. This enables the liquid spray nozzle 18A according to the second exemplary embodiment to spray a larger amount of ink onto each medium in the intermediate layer than the liquid spray nozzle 18Z according to the comparative example. Thus, the liquid spray nozzle 18A may efficiently stain each medium in the intermediate layer, which is most difficult to stain.

As is clear from equation (1), the cross-sectional area of the liquid spray holes 18*ho* in the lower layer (SP4) of the liquid spray nozzle 18A according to the second exemplary embodiment is set with a smaller value than the cross-sectional area of the liquid spray holes 18*ho* in the lower layer (SP1) of the liquid spray nozzle 18Z according to the comparative example.

Similarly, as is clear from equation (3), the cross-sectional area of the liquid spray holes 18*ho* in the upper layer (SP6) of the liquid spray nozzle 18A according to the second exemplary embodiment is set with a smaller value than the cross-sectional area of the liquid spray holes 18*ho* in the upper layer (SP3) of the liquid spray nozzle 18Z according to the comparative example.

This enables the liquid spray nozzle 18A according to the second exemplary embodiment to spray smaller amounts of ink onto each medium in the lower layer and the upper layer, which may be stained relatively easily, than the liquid spray nozzle 18Z according to the comparative example. This enables the amount of wasted ink used by the liquid spray nozzle 18A to be reduced.

As is clear from equation (4), the liquid spray holes 18*ho* of the liquid spray nozzle 18A according to the second exemplary embodiment are set such that the cross-sectional area of those in the upper layer (SP6) are the smallest, the cross-sectional area of those in the lower layer (SP4) are the second smallest, and the cross-sectional area of those in the intermediate layer (SP5) are the largest. Thus, the liquid spray nozzle 18A according to the second exemplary embodiment enables the amounts of ink sprayed onto each medium in the lower layer and the upper layer, which may be stained relatively easily, to be reduced, reducing the amount of wasted ink used, and also enables the amount of ink sprayed onto each medium in the intermediate layer to be increased, enabling each medium in the intermediate layer, which is most difficult to stain, to be efficiently stained.

Modified Examples of Liquid Spray Nozzle

Figure 11A:
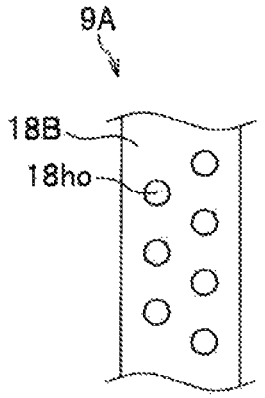
FIG. 11A is a drawing schematically illustrating a configuration of a modified example of a liquid spray nozzle employed in the liquid spraying mechanism according to the second exemplary embodiment.
Figure 11B:
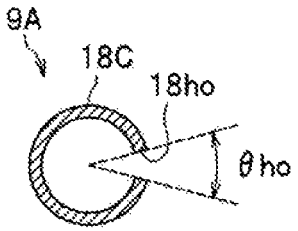
FIG. 11B is a drawing schematically illustrating a configuration of another modified example of a liquid spray nozzle employed in the liquid spraying mechanism according to the second exemplary embodiment.

The liquid spray nozzle 18A may be modified, as in a liquid spray nozzle 18B illustrated in FIG. 11A and a liquid spray nozzle 18C illustrated in FIG. 11B, for example. FIG. 11A is a drawing schematically illustrating a configuration of the liquid spray nozzle 18B according to a modified example. FIG. 11B is a drawing schematically illustrating a configuration of the liquid spray nozzle 18C according to a separate modified example.

As illustrated in FIG. 11A, the liquid spray nozzle 18B according to the modified example is a nozzle in which the liquid spray holes 18*ho* are configured disposed in two rows having alternately different angles (positions offset in the horizontal direction) to each other (namely, an alternating configuration), rather than in one row as in the liquid spray nozzle 18A.

As illustrated in FIG. 11B, the liquid spray nozzle 18C according the separate modified example is a nozzle with a configuration in which an opening angle θho of the liquid spray holes 18*ho* is changed at every height direction position, unlike in the liquid spray nozzle 18A.

The liquid spray nozzles 18B, 18C may be configured by either a metal material or a resin material.

As described above, the liquid spraying mechanism 9A according to the second exemplary embodiment increases the stained surface area of each medium stacked in the vertical direction, and enables all the media to be stained over a wide range, similarly to the liquid spraying mechanism 9 according to the first exemplary embodiment.

Compared to the liquid spraying mechanism 9 according to the first exemplary embodiment, the liquid spraying mechanism 9A further reduces the amount of ink sprayed onto each medium in the lower layer and the upper layer, which may be relatively easily stained, enabling the amount of wasted ink used to be reduced, and also increases the amount of ink sprayed onto each medium in the intermediate layer, which is most difficult to stain, enabling each medium in the intermediate layer, which is most difficult to stain, to be efficiently stained.

Third Exemplary Embodiment

A third exemplary embodiment provides a liquid spraying mechanism 9B configured such that ink easily flows to the vicinity of the center portion of a length direction end face of the stacked medium.

Figure 12A:
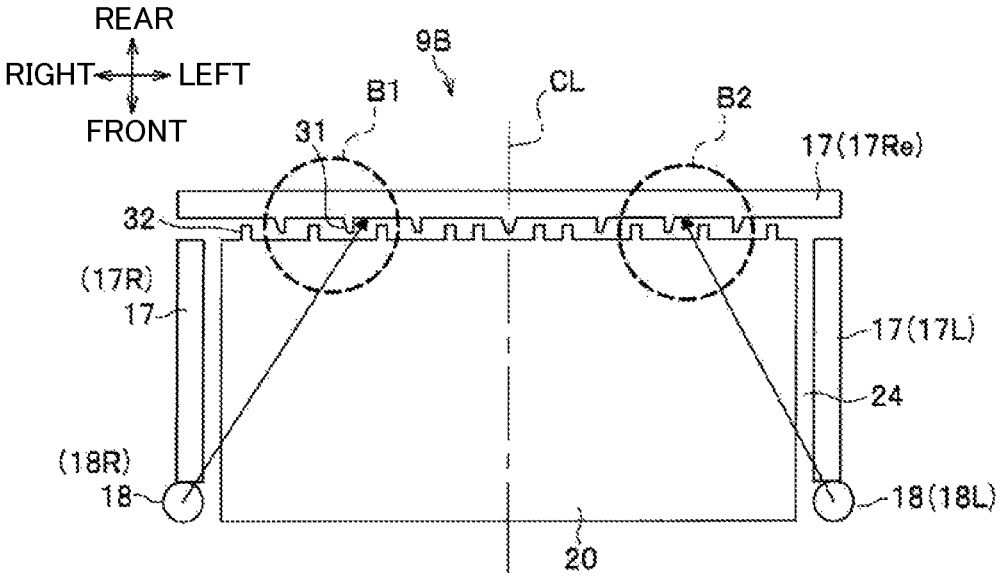
FIG. 12A is a drawing (1) illustrating a configuration of a liquid spraying mechanism according to a third exemplary embodiment.
Figure 12B:
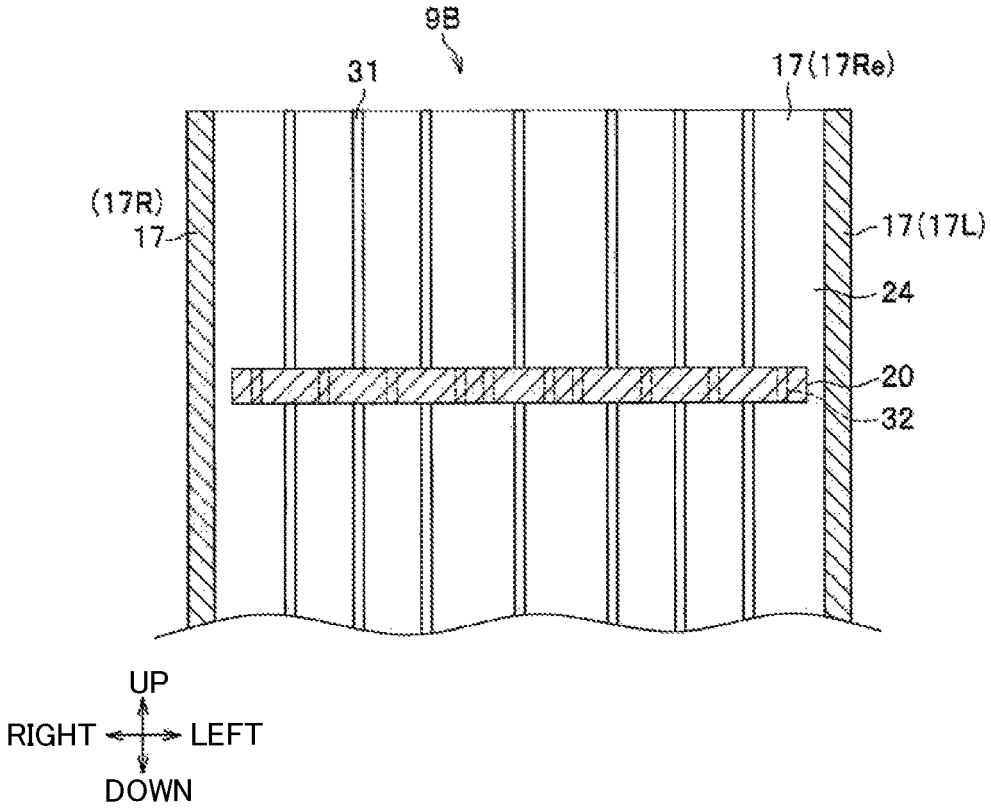
FIG. 12B is a drawing (2) illustrating a configuration of the liquid spraying mechanism according to the third exemplary embodiment.
Figure 12C:
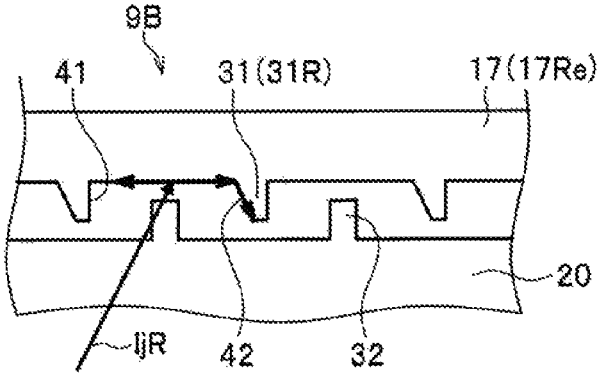
FIG. 12C is a drawing (3) illustrating a configuration of the liquid spraying mechanism according to the third exemplary embodiment.
Figure 12D:
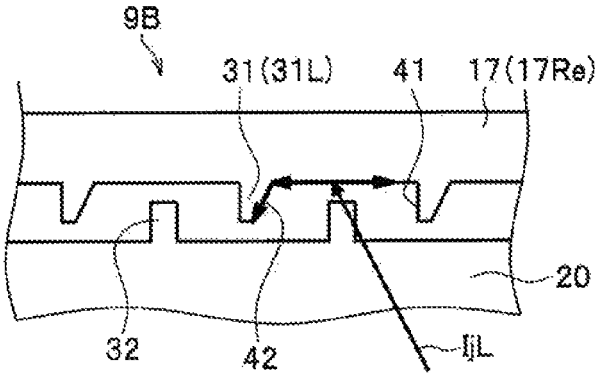
FIG. 12D is a drawing (4) illustrating a configuration of the liquid spraying mechanism according to the third exemplary embodiment.

Explanation follows regarding a configuration of the liquid spraying mechanism 9B according to the third exemplary embodiment, with reference to FIG. 12A to FIG. 12D. FIG. 12A to 12D are drawings illustrating a configuration of the liquid spraying mechanism 9B according to the third exemplary embodiment. FIG. 12A illustrates a configuration of the liquid spraying mechanism 9B as viewed from above. FIG. 12B illustrates a configuration of the liquid spraying mechanism 9B as viewed from in front. FIG. 12C illustrates an enlarged configuration of region B1 illustrated in FIG. 12A. FIG. 12D illustrates an enlarged configuration of region B2 illustrated in FIG. 12A.

Note that, since a feature of the liquid spraying mechanism 9B is the flow of ink sprayed from left and right liquid spray nozzles 18, configuration of the liquid spraying mechanism 9B is illustrated in FIG. 12A to 12D with the liquid spray nozzle 18Re omitted. However, the liquid spray nozzle 18Re is present in practice.

As illustrated in FIG. 12A and FIG. 12B, the liquid spraying mechanism 9B according to the third exemplary embodiment is configured including ribs 31 formed on the rear guide member 17Re and ribs 32 formed on the stage 20, in order to prevent the medium from entering a gap between the rear guide member 17Re and the stage 20.

The ribs 31 and the ribs 32 are locations formed in order to guide the flow of ink. The ribs 31 and the ribs 32 are disposed alternately to each other in a nested relationship.

The ribs 31 are formed on the inner wall face (guide face) of the rear guide member 17Re so as to project out toward the stackable space 24. The ribs 31 are formed extending across the entire vertical direction (height direction) area, so as to correspond to the entire area of the stackable space 24 in the vertical direction (height direction).

The ribs 32 are formed at a rear side edge of the stage 20 so as to project out toward the guide member 17Re.

As illustrated in FIG. 12C and FIG. 12D, each rib 31 includes a flat face facing the stage 20 and two flat faces formed on the left and right of this flat face. One of the left or right flat faces forms a wall portion 41 disposed in a substantially perpendicular direction with respect to the inner wall face (guide face) of the rear guide member 17Re. The other of the flat faces forms an inclined face 42 disposed at an incline with respect to the inner wall face (guide face) of the rear guide member 17Re.

As illustrated in FIG. 12C, the inclined faces 42 are formed on the right (the side furthest from a center line CL) of the ribs 31 formed further to the right than the center line CL (see FIG. 12A) (hereafter referred to as ribs 31R). As illustrated in FIG. 12D, the inclined faces 42 are formed on the left (the side furthest from the center line CL) of the ribs 31 formed further to the left than the center line CL (see FIG. 12A) (hereafter referred to as ribs 31L). Each inclined face 42 is formed such that an interior angle with the inner wall face (guide face) of the rear guide member 17Re is an acute angle.

In the liquid spraying mechanism 9B, the inclined faces 42 are formed to the ribs 31 of the rear guide members 17R, thereby facilitating the flow of ink toward the center line CL (see FIG. 12A), this being the center of the guide member 17Re.

Figure 13:
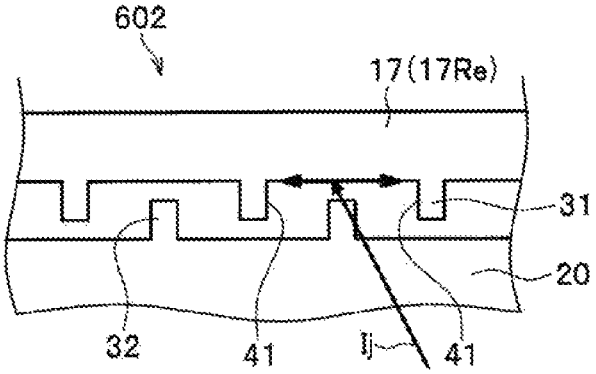
FIG. 13 is a drawing illustrating a flow of liquid in a liquid spraying mechanism according to a comparative example.

In order to facilitate explanation of the flow of ink in the liquid spraying mechanism 9B according to the third exemplary embodiment, first, a flow of ink in a liquid spraying mechanism 602 according to a comparative example is explained with reference to FIG. 13. The flow of ink in the liquid spraying mechanism 9B according to the third exemplary embodiment is explained after this. FIG. 13 is a drawing illustrating the flow of ink in the liquid spraying mechanism 602 according to the comparative example.

As illustrated in FIG. 13, in the liquid spraying mechanism 602 according to the comparative example, both left and right flat faces formed on each rib 31 form wall portions 41 disposed in a substantially perpendicular direction with respect to the inner wall face (guide face) of the rear guide member 17Re.

In the liquid spraying mechanism 602 according to the comparative example, ink Ij sprayed from the right liquid spray nozzle 18R and the left liquid spray nozzle 18L is applied to the inner wall face (guide face) of the rear guide member 17Re, and flows toward the left and right. When this occurs, since the ink is applied to the wall portions 41, the ink stops at the wall portions 41 without being able to flow over the ribs.

In contrast thereto, in the liquid spraying mechanism 9B according to the third exemplary embodiment, as illustrated in FIG. 12C, for example, ink IjR sprayed from the liquid spray nozzle 18R (see FIG. 12A) is applied to the inner wall face (guide face) of the rear guide member 17Re, and flows toward the inclined faces 42 and toward the wall portions 41. When this occurs, ink that has flowed toward the inclined faces 42 flows over the ribs 31R and flows toward the center line CL. Ink that has flowed toward the wall portions 41 is applied onto the wall portions 41, and stops at the wall portions 41 without being able to flow over the ribs 31R.

Similarly, as illustrated in FIG. 12D, ink IjL sprayed from the liquid spray nozzle 18L (see FIG. 12A) is applied to the inner wall face (guide face) of the rear guide member 17Re, and flows toward the inclined faces 42 and toward the wall portions 41. When this occurs, ink that has flowed toward the inclined faces 42 flows over the ribs 31L and flows toward the center line CL. Ink that has flowed toward the wall portions 41 is applied onto the wall portions 41, and stops at the wall portions 41 without being able to flow over the ribs 31L.

In the liquid spraying mechanism 9B according to the third exemplary embodiment with the above configuration, the flat face of each rib 31 that is furthest from the center line CL forms the inclined face 42. Thus, the liquid spraying mechanism 9B may facilitate the flow of ink toward the center line CL. Namely, the liquid spraying mechanism 9B may facilitate the flow of ink between the stacked medium and the rear guide member 17Re. Thus, the liquid spraying mechanism 9B enables the ink to be made to efficiently adhere to the stacked medium, and enables the stained surface area of each medium to be increased.

In the liquid spraying mechanism 9B, the flat face of each rib 31 that is nearest to the center line CL forms the wall portion 41. Thus, in the liquid spraying mechanism 9B, ink may be suppressed from flowing out away from the center line CL (away from the stacked medium). Thus, the liquid spraying mechanism 9B enables the amount of wasted ink that does not adhere to the stacked medium to be reduced. Thus, the liquid spraying mechanism 9B enables a wide range of the end faces of the stacked medium to be efficiently stained using a small amount of ink.

Note that in the third exemplary embodiment, the inclined faces 42 are formed on the ribs 31; however, curved faces (rounded faces) may be formed on the ribs 31 instead of the inclined faces 42.

As described above, the liquid spraying mechanism 9B according to the third exemplary embodiment enables the stained surface area of each medium stacked in the vertical direction to be increased and all the media to be stained over a wide range, similarly to the liquid spraying mechanisms 9 and 9A according to the first and second exemplary embodiments.

Moreover, the liquid spraying mechanism 9B makes it easier for ink to flow toward the center line CL and also is able to suppress ink from flowing out away from the center line CL (away from the stacked medium) better than the liquid spraying mechanisms 9 and 9A according to the first and second exemplary embodiments. The liquid spraying mechanism 9B thereby enables the amount of wasted ink that does not adhere to the stacked medium to be reduced. Thus, the liquid spraying mechanism 9B enables the end faces of the stacked medium to be efficiently stained over a wide range using a small amount of ink.

Fourth Exemplary Embodiment

A fourth exemplary embodiment provides a liquid spraying mechanism 9C configured so as to facilitate the flow of ink in the vicinity of a position at the intermediate layer of the stacked medium in particular.

Figure 14A:
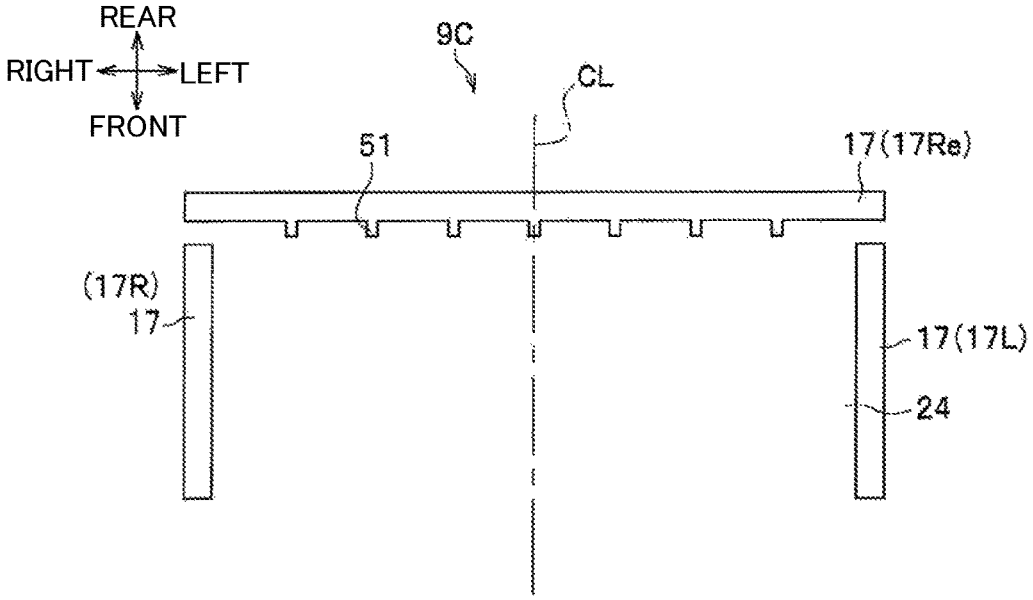
FIG. 14A is a drawing (1) illustrating a configuration of a liquid spraying mechanism according to a fourth exemplary embodiment.
Figure 14B:
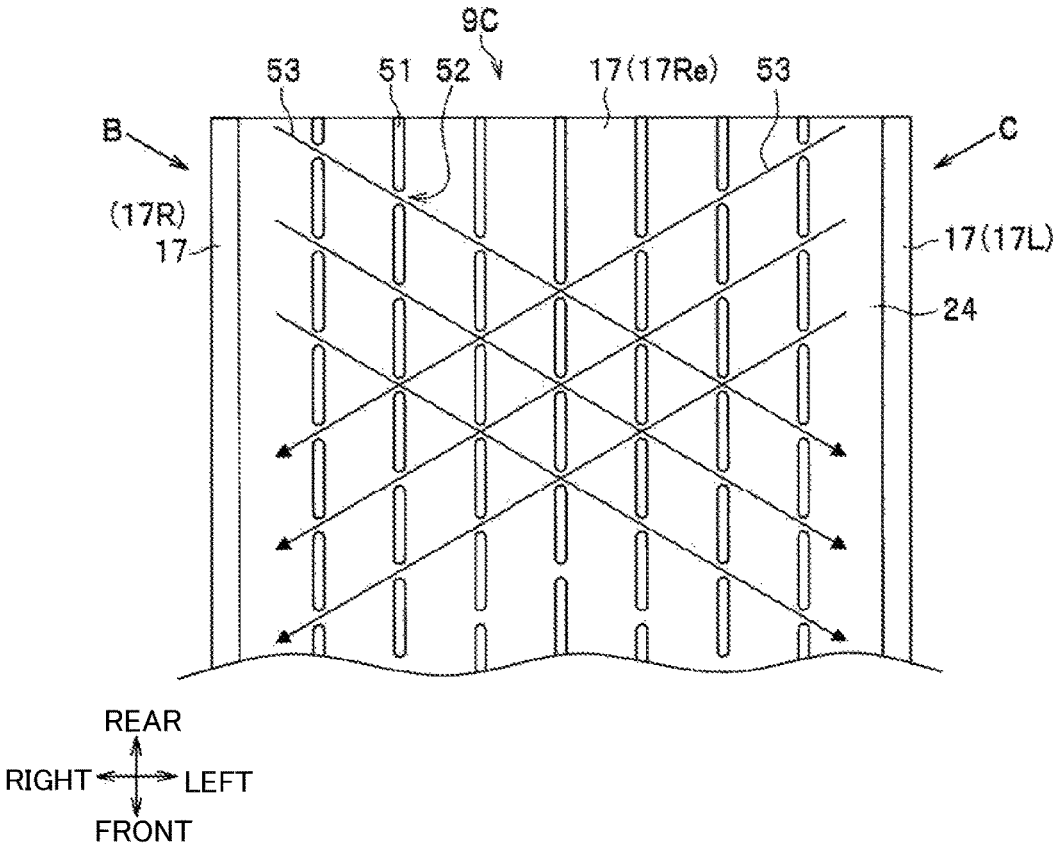
FIG. 14B is a drawing (2) illustrating a configuration of the liquid spraying mechanism according to the fourth exemplary embodiment.
Figure 14C:
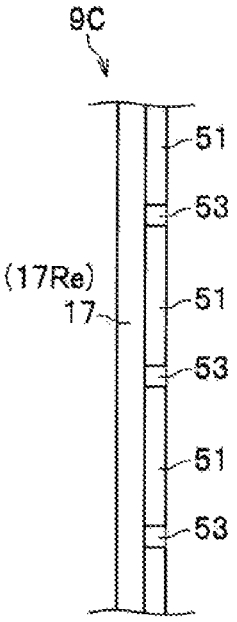
FIG. 14C is a drawing (3) illustrating a configuration of the liquid spraying mechanism according to the fourth exemplary embodiment.
Figure 14D:
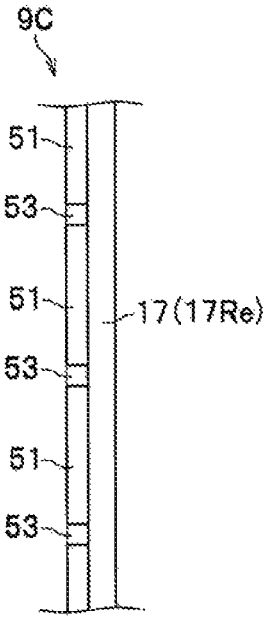
FIG. 14D is a drawing (4) illustrating a configuration of the liquid spraying mechanism according to the fourth exemplary embodiment.

Explanation follows regarding a configuration of the liquid spraying mechanism 9C according to the fourth exemplary embodiment, with reference to FIG. 14A to FIG. 14D. FIG. 14A to FIG. 14D are drawings illustrating a configuration of the liquid spraying mechanism 9C according to the fourth exemplary embodiment. FIG. 14B illustrates a configuration of the liquid spraying mechanism 9C as viewed from the front. FIG. 14C illustrates a shape of a rib 51 as viewed from the arrow B direction illustrated in FIG. 14B. FIG. 14D illustrates a shape of a rib 51 as viewed from the arrow C direction illustrated in FIG. 14B.

Note that, since a feature of the liquid spraying mechanism 9C is the shape of the ribs 51 formed on the inner wall face (guide face) of the rear guide member 17Re, configuration of the liquid spraying mechanism 9C is illustrated in FIG. 14A to FIG. 14D with the liquid spray nozzles 18Re, 18R, and 18L, and the stage 20 omitted. However, the liquid spray nozzles 18Re, 18R, and 18L, and the stage 20 present in practice.

As illustrated in FIG. 14A and FIG. 14B, the liquid spraying mechanism 9C according to the fourth exemplary embodiment is different from the liquid spraying mechanism 9B according to the third exemplary embodiment (see FIG. 12A and FIG. 12B) in that the ribs 51 are formed on the inner wall face (guide face) of the rear guide member 17Re instead of the ribs 31. The ribs 51 are projecting portions shaped so as to be interrupted partway along the vertical direction.

As illustrated in FIG. 12B, the ribs 31 of the liquid spraying mechanism 9B according to the third exemplary embodiment are formed so as to extend along the entire area of the inner wall face (guide face) of the rear guide member 17Re in the vertical direction (height direction).

In contrast thereto, as illustrated in FIG. 14B, the ribs 51 of the liquid spraying mechanism 9C according to the fourth exemplary embodiment are formed sectionally along the vertical direction (height direction) of the inner wall face (guide face) of the rear guide member 17Re. Namely, each rib 51 has a shape that is interrupted partway along the vertical direction, with openings 52 formed sectionally therein.

Thus, as illustrated in FIG. 14A, for example, when the guide member 17Re is viewed from above, the ribs 51 appear to extend along the entire area of the inner wall face (guide face) of the guide member 17Re in the vertical direction (height direction). However, as illustrated in FIG. 14C and FIG. 14D, for example, each rib 51 is actually configured such that plural openings (dividing portions) 52, functioning as ink passageways 53, pierce through (divide) partway portions of the rib 51 in the vertical direction.

Note that, although the inclined faces 42 (see FIG. 12C and FIG. 12D) are not formed on the ribs 51 in the example illustrated in FIG. 14B, the inclined faces 42 may be formed thereon.

Plural openings 52 are formed in a single rib 51. As illustrated in FIG. 14B, the openings 52 are formed crossing the respective ribs 51 so as to pierce through the respective ribs in an oblique direction on the guide face, thereby forming plural ink passageways 53. Each ink passageway 53 is formed in a straight line extending along the guide face in an oblique direction. The respective ink passageways 53 intersect with each other in the vicinity of a position of the inner wall face (guide face) of the rear guide member 17Re that faces the intermediate layer of the stacked medium.

In the liquid spraying mechanism 9C, ink sprayed from the right liquid spray nozzle 18R and the left liquid spray nozzle 18L is applied to the inner wall face (guide face) of the rear guide member 17Re and flows toward the left and right. When this occurs, the ink also flows downward as well as toward the left and right. Some of the ink flowing downward passes through the ink passageways 53 and flows obliquely downward toward the center line CL.

The respective ink passageways 53 intersect with each other in the vicinity of a position of the inner wall face (guide face) of the rear guide member 17Re that faces the intermediate layer of the stacked medium. Thus, the ink passing through the respective ink passageways 53 flows in the vicinity of a position of the intermediate layer of the stacked medium in particular. Thus, the liquid spraying mechanism 9C enables ink to be made to adhere to the intermediate layer of the stacked medium in particular.

The liquid spraying mechanism 9C according to the fourth exemplary embodiment with the above configuration enables a contact surface area of the ink with the stacked medium to be increased by guiding the ink flowing downward so as to flow obliquely downward, thereby enabling the ink to be made to efficiently adhere to the stacked medium. The liquid spraying mechanism 9C thereby enables the amount of wasted ink that does not adhere to the stacked medium to be reduced. Thus, the liquid spraying mechanism 9C enables the end faces of the stacked medium to be efficiently stained over a wide range using a small amount of ink.

The liquid spraying mechanism 9C enables the flow of ink to be guided so as to flow in the vicinity of a position of the intermediate layer of the stacked medium, thereby enabling the stained surface area of each medium to be increased at the intermediate layer in particular.

As described above, the liquid spraying mechanism 9C according to the fourth exemplary embodiment enables the stained surface area of each medium stacked in the vertical direction to be increased and all the media to be stained over a wide range, similarly to the liquid spraying mechanisms 9 to 9B according to the first to third exemplary embodiments.

Moreover, the liquid spraying mechanism 9C enables the flow of ink to be guided such that ink flows in the vicinity of a position of the intermediate layer of the stacked medium, thereby enabling the stained surface area of each medium to be increased at the intermediate layer in particular, compared to the liquid spraying mechanisms 9 to 9B according to the first to third exemplary embodiments.

Fifth Exemplary Embodiment

A fifth exemplary embodiment provides a liquid spraying mechanism 9D that facilitates penetration of ink into the stacked medium by spraying ink plural times.

Figure 15:
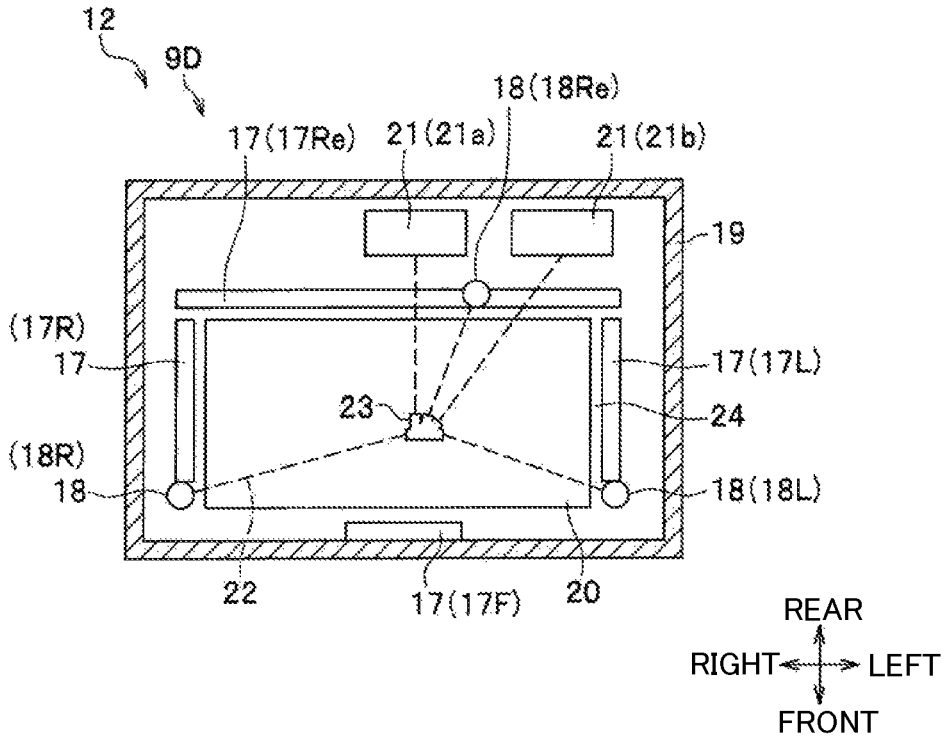
FIG. 15 is a drawing schematically illustrating a configuration of a liquid spraying mechanism according to a fifth exemplary embodiment.

Explanation follows regarding a configuration of the liquid spraying mechanism 9D according to the fifth exemplary embodiment, with reference to FIG. 15. FIG. 15 is a drawing schematically illustrating a configuration of the liquid spraying mechanism 9D according to the fifth exemplary embodiment.

As illustrated in FIG. 15, the liquid spraying mechanism 9D according to the fifth exemplary embodiment differs from the liquid spraying mechanism 9 according to the first exemplary embodiment (see FIG. 3) in the respect that the two liquid tanks 21*a*, 21*b* are connected to the three liquid spray nozzles 18Re, 18R, and 18L through the pipes 22 and the liquid branching member 23. As explained below, the liquid spraying mechanism 9D also differs from the liquid spraying mechanism 9 in the respect that the liquid tank 21*a* and the liquid tank 21*b* are actuated at different timings.

Figure 16A:
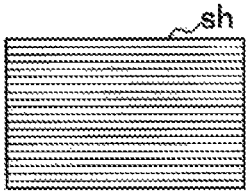
FIG. 16A is a drawing illustrating an operating example of the liquid spraying mechanism according to the fifth exemplary embodiment.
Figure 16B:
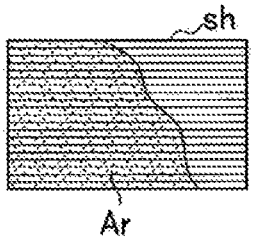
FIG. 16B is a drawing illustrating an operating example of the liquid spraying mechanism according to the fifth exemplary embodiment.
Figure 16C:
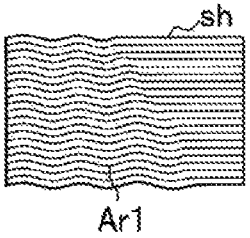
FIG. 16C is a drawing illustrating an operating example of the liquid spraying mechanism according to the fifth exemplary embodiment.
Figure 16D:
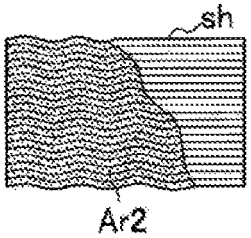
FIG. 16D is a drawing illustrating an operating example of the liquid spraying mechanism according to the fifth exemplary embodiment.

Explanation follows regarding operation of the liquid spraying mechanism 9D, with reference to FIG. 16A to FIG. 16D. FIG. 16A to FIG. 16D are drawings illustrating examples of operation of the liquid spraying mechanism 9D. FIG. 16A illustrates a state of a stacked medium sh prior to a first spray of ink. FIG. 16B illustrates a state of the stacked medium sh after the first spray of ink. FIG. 16C illustrates a state of the stacked medium sh after a fixed time has passed since the first spray of ink. FIG. 16D illustrates a state of the stacked medium sh after a second spray of ink.

The stacked medium sh is stacked on the stage 20 (see FIG. 15). As illustrated in FIG. 16A, the stacked medium sh is in a closely contacted state without any gaps between each medium prior to the first spray of ink. Thus, each medium of the stacked medium sh is in a state in which it is difficult for the ink to penetrate into the stacked medium.

When an emergency has occurred, first, the controller of the cash handling device 1 outputs an ink spray command to the non-illustrated liquid spray controller provided inside the liquid spraying mechanism 9D.

In response thereto, the non-illustrated liquid spray controller of the liquid spraying mechanism 9D first operates the non-illustrated pressurizing mechanism provided at the periphery of one of the liquid tanks 21*a* or 21*b*. Explanation follows envisaging a case in which the pressurizing mechanism provided at the periphery of the liquid tank 21*a* is actuated. The pressurizing mechanism pressurizes ink stored in the liquid tank 21*a*, and feeds out ink from the liquid tank 21*a* to the respective pipe 22.

Ink that has been fed out from the liquid tank 21*a* flows through the pipe 22, is divided at the liquid branching member 23, and flows toward the respective liquid spray nozzles 18Re, 18R, and 18L. Thus, the liquid spray nozzles 18Re, 18R, and 18L perform the first spray of ink toward the medium. When this occurs, since each medium of the stacked medium sh is in a state in which ink penetration is difficult, and it results in a state in which the medium is only stained over a narrower range, as illustrated in FIG. 16B.

The non-illustrated liquid spray controller of the liquid spraying mechanism 9D then stands by until a fixed time has passed. During this time, as illustrated in FIG. 16C, wrinkles develop in stained portions of each medium of the stacked medium sh, and the stained portions take on a rippled state. Thus, gaps occur between each one medium and another medium. Each medium thereby enters a state in which ink penetration is facilitated.

After standing by until the fixed time has passed, the non-illustrated liquid spray controller of the liquid spraying mechanism 9D actuates the non-illustrated pressurizing mechanism provided at the periphery of the other of the liquid tanks 21*a* or 21*b* (the liquid tank 21*b* in this case). The pressurizing mechanism pressurizes ink stored in the liquid tank 21*b*, and feeds out ink from the liquid tank 21*b* to the respective pipe 22.

Ink that has been fed out from the liquid tank 21*b* flows through the pipe 22, is divided at the liquid branching member 23, and flows toward the respective liquid spray nozzles 18Re, 18R, and 18L. Thus, the liquid spray nozzles 18Re, 18R, and 18L perform a second spray of ink toward the medium. Due to each medium of the stacked medium sh being in a state in which ink easily penetrates when this is performed, a state results stained over a wide range, as illustrated in FIG. 16D.

In the liquid spraying mechanism 9D according to the fifth exemplary embodiment with the above configuration, the spraying of ink is divided into several times. Thus, the liquid spraying mechanism 9D causes the end face portions of the stacked medium to absorb ink and wrinkles to develop in each medium, thereby causing gaps to form between each medium, at the first spray of ink. The liquid spraying mechanism 9D then causes ink to penetrate as far as interior portions of the stacked medium at the second spray of ink. The liquid spraying mechanism 9D thereby enables the stained surface area of each medium to be increased.

As explained above, the liquid spraying mechanism 9D according to the fifth exemplary embodiment enables the stained surface area of each medium stacked in the vertical direction to be increased and all the media to be stained over a wide range, similarly to the liquid spraying mechanisms 9 to 9C according to the first to fourth exemplary embodiments.

Moreover, the liquid spraying mechanism 9D enables ink to penetrate as far as the interior portions of the stacked medium better than the liquid spraying mechanisms 9 to 9C according to the first to fourth exemplary embodiments, thereby enabling the stained surface area of each medium to be increased.

Sixth Exemplary Embodiment

The liquid spraying mechanisms 9 to 9D according to the first to fifth exemplary embodiments are configured such that the liquid tanks 21 are disposed inside each medium storage box 12. However, there is a tendency to demand lighter weight and more compact medium storage boxes 12, and also a tendency to demand an increased number of sheets of stored medium. Thus, there is a possibility that only small size liquid tanks 21 may be disposed in the medium storage box 12.

Supposing a case in which only small size liquid tanks 21 may be disposed in the medium storage box 12, the liquid spraying mechanisms 9 to 9D are only able to spray a relatively small amount of ink. There is a possibility that a large amount of ink in order to stain a large number of sheets of medium may not be secured in the liquid spraying mechanisms 9 to 9D. The liquid spraying mechanisms 9 to 9D are configured in consideration of efficiently staining each medium using a small amount of ink, so as to be able to handle such a case.

In contrast thereto, the sixth exemplary embodiment provides a liquid spraying mechanism 9E that enables the medium storage box 12 to be lighter in weight and more compact, enables the number of stored sheets of medium to be increased, and also enables a relatively larger amount of ink to be sprayed and a larger number of sheets of the medium to be stained, compared to the liquid spraying mechanisms 9 to 9D according to the first to fifth exemplary embodiments.

The liquid spraying mechanism 9E according to the sixth exemplary embodiment (see FIG. 18A and FIG. 18B) differs from the liquid spraying mechanism 9 according to the first exemplary embodiment (see FIG. 3) in that the liquid tanks 21 are disposed outside the medium storage boxes 12.

Configuration of Liquid Spraying Mechanism

Explanation follows regarding a configuration of the liquid spraying mechanism 9E according to the sixth exemplary embodiment, with reference to FIG. 17A to FIG. 20.

Figure 17A:
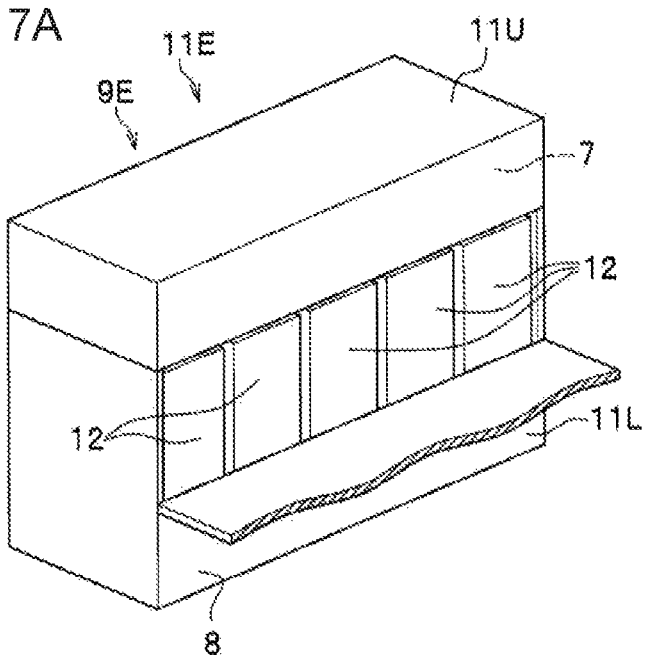
FIG. 17A is a drawing illustrating a configuration of medium storage boxes and a casing section applied with a liquid spraying mechanism according to a sixth exemplary embodiment.
Figure 17B:
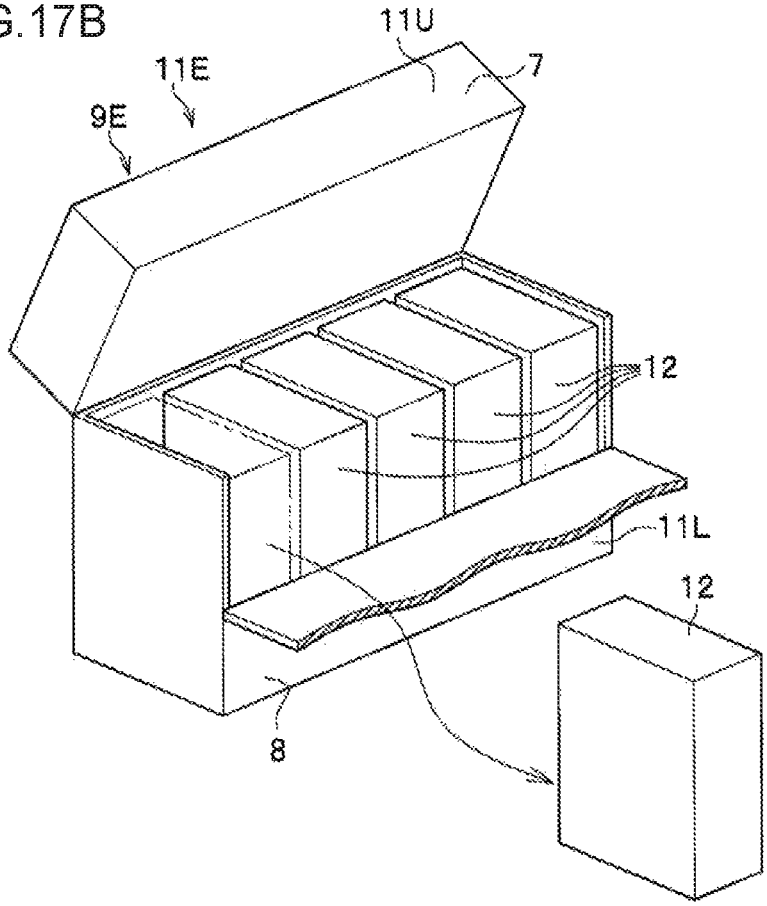
FIG. 17B is a drawing illustrating a configuration of the medium storage boxes and the casing section applied with the liquid spraying mechanism according to the sixth exemplary embodiment.

FIG. 17A to FIG. 17B are drawings illustrating a configuration of the medium storage boxes 12 and a casing section (loading frame) 11E loaded with the medium storage boxes 12, applied with the liquid spraying mechanism 9E according to the sixth exemplary embodiment. FIG. 17A illustrates a configuration of the casing section 11E in a state in which an upper section 11U is closed. FIG. 17B illustrates a configuration of the casing section 11E in a state in which the upper section 11U is open.

Figure 18A:
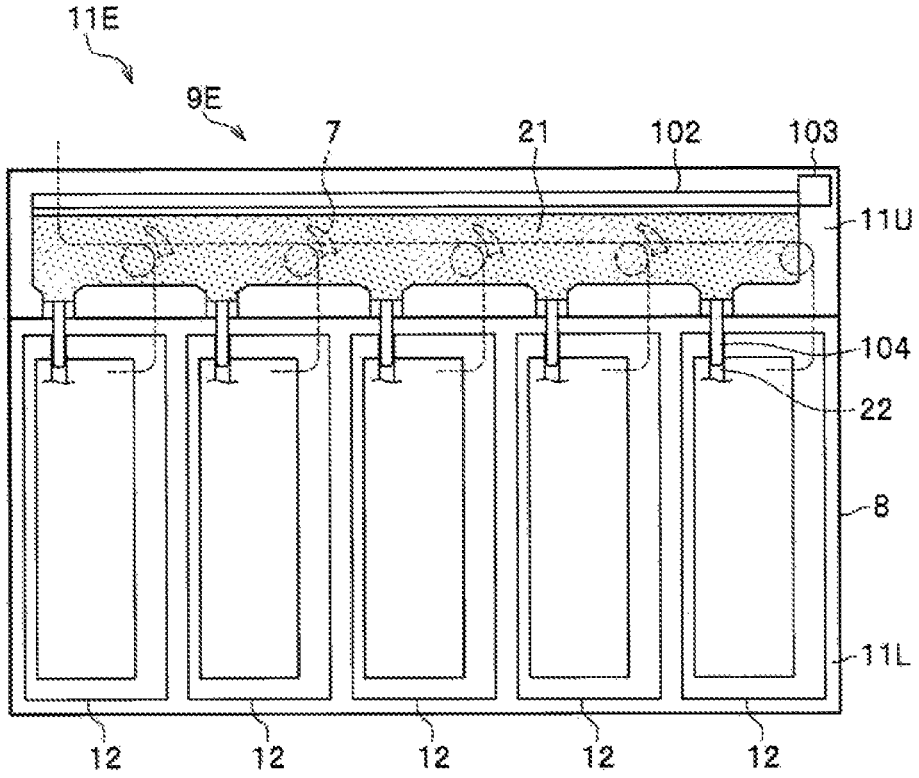
FIG. 18A is a drawing schematically illustrating a configuration of a liquid spraying mechanism according to the sixth exemplary embodiment.
Figure 18B:
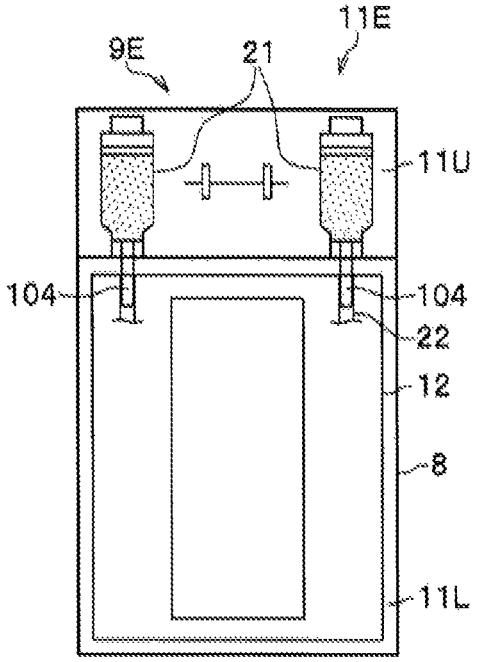
FIG. 18B is a drawing schematically illustrating a configuration of the liquid spraying mechanism according to the sixth exemplary embodiment.

FIG. 18A to FIG. 18B are drawings schematically illustrating a configuration of the liquid spraying mechanism 9E. FIG. 18A illustrates a configuration of the liquid spraying mechanism 9E as viewed from the side. FIG. 18B illustrates a configuration of the liquid spraying mechanism 9E as viewed from the front.

Figure 19A:
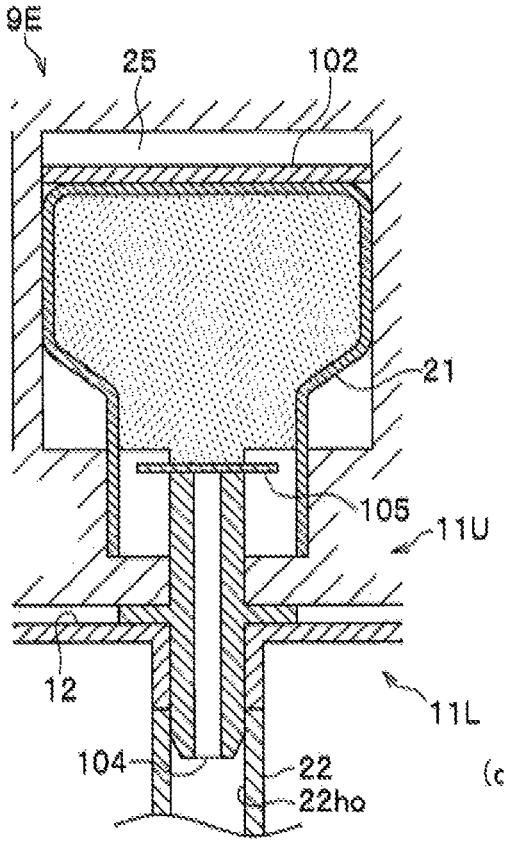
FIG. 19A is a drawing illustrating configuration of relevant portions of the liquid spraying mechanism according to the sixth exemplary embodiment.
Figure 19B:
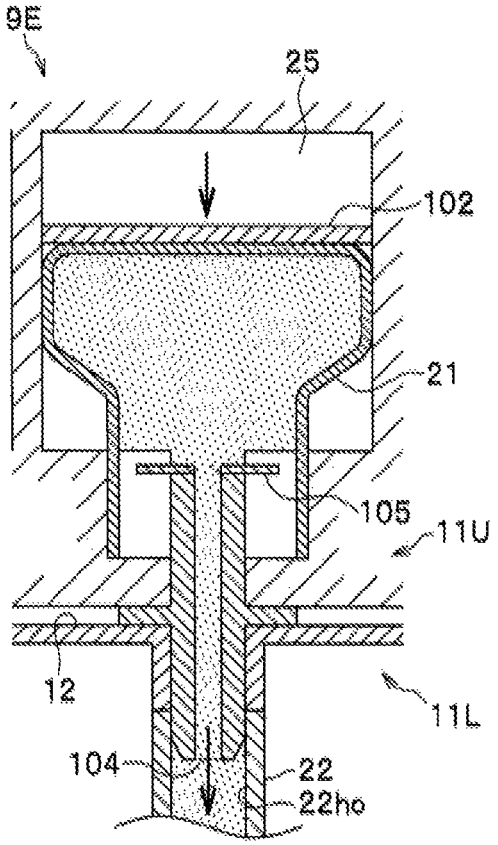
FIG. 19B is a drawing illustrating configuration of relevant portions of the liquid spraying mechanism according to the sixth exemplary embodiment.
Figure 19C:
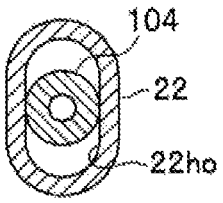
FIG. 19C is a drawing illustrating configuration of relevant portions of the liquid spraying mechanism according to the sixth exemplary embodiment.

FIG. 19A to FIG. 19C are partially enlarged views of FIG. 18B, illustrating a configuration of relevant portions of the liquid spraying mechanism 9E. FIG. 19A illustrates a configuration of relevant portions of the liquid spraying mechanism 9E when gas generators 103, described later, are not actuated. FIG. 19B illustrates a configuration of relevant portions of the liquid spraying mechanism 9E when the gas generators 103, described later, are actuated. FIG. 19C is a cross-section of the pipes 22 in FIG. 19A and FIG. 19B sectioned along the horizontal direction, illustrating a configuration of a coupling mechanism of the liquid spraying mechanism 9E.

Figure 20:
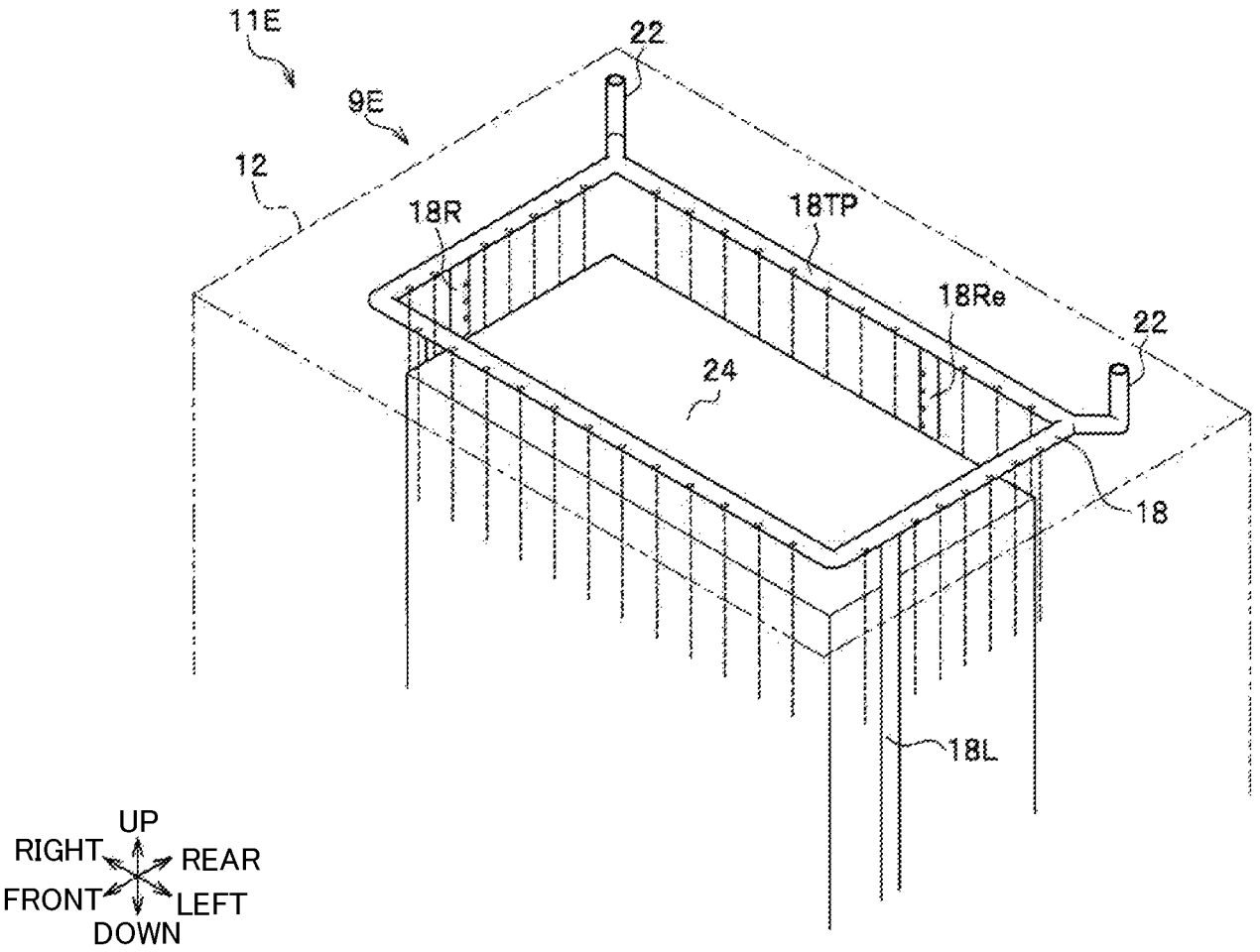
FIG. 20 is a drawing illustrating a configuration of liquid spray nozzles of the liquid spraying mechanism according to the sixth exemplary embodiment.

FIG. 20 is a drawing illustrating a configuration of the liquid spray nozzles 18 of the liquid spraying mechanism 9E.

As illustrated in FIG. 17A, in the sixth exemplary embodiment, plural (five in this case) medium storage boxes 12 are loaded into the casing section (loading frame) 11E. The casing section 11E is a frame structure body into which the medium storage boxes 12 are loaded. The casing section 11E is disposed inside the safe 11 of the cash handling device 1 (see FIG. 1) during operation. The casing section 11E is supported by a slide rail or the like so as to be capable of moving, and may be pulled out from inside the safe 11 of the cash handling device 1 to the exterior when attaching and removing the medium storage boxes 12. FIG. 17B illustrates a state when the casing section 11E has been pulled out from inside the cash handling device 1 to the exterior, from which illustration of the cash handling device 1 is omitted.

The casing section 11E is configured split into the upper section 11U and a lower section 11L. The upper section 11U is a location including the sorting conveyance section 7, previously described, inside. The lower section 11L is a location functioning as the lower unit 8 into which the medium storage boxes 12 are loaded.

In the example illustrated in FIG. 17B, the upper section 11U is axially supported in the vicinity of a length direction side edge of the lower section 11L, and is configured so as to be capable of turning with respect to the lower section 11L. By turning the upper section 11U, the casing section 11E enters a state in which the space inside the lower section 11L is open to the exterior, and the medium storage boxes 12 may be attached (loaded) and removed. A non-illustrated mechanism for regulating the attachment position of each medium storage box 12 is provided to the lower section 11L.

Ink flow-paths are formed inside the upper section 11U and inside the medium storage boxes 12. In the following explanation, the flow-paths formed inside the upper section 11U are referred to as "casing inner flow-paths". The flow-paths formed inside the medium storage boxes 12 are referred to as "unit inner flow-paths". The "casing inner flow-paths" are flow-paths for supplying ink from the liquid tanks 21 to each medium storage box 12. The "unit inner flow-paths" are flow-paths for supplying ink supplied to each medium storage box 12 to the liquid spray nozzles 18.

As illustrated in FIG. 18A and FIG. 18B, the upper section 11U includes the liquid tanks 21 disposed above the medium storage boxes 12 at the periphery of the sorting conveyance section 7. In the sixth exemplary embodiment, the liquid tanks 21 are configured so as to supply ink to all the medium storage boxes 12 loaded in the casing section 11E.

The ink storage amount of the liquid tanks 21 in the sixth exemplary embodiment is larger than the total ink storage amount of the two liquid tanks 21*a*, 21*b* for the five medium storage boxes 12 of the liquid spraying mechanisms 9 to 9D according to the first to fifth exemplary embodiments.

Positioning pins 104 are connected to the liquid tanks 21 in order to align the positions of a medium exchange port of each medium storage box 12 and a respective medium exchange port of the upper section 11U. The positioning pins 104 are members which, together with insertion ports 22*ho* (see FIG. 19A to FIG. 19C), configure coupling mechanisms that couple the casing inner flow-paths and the unit inner flow-paths together.

The insertion ports 22*ho* (see FIG. 19A to FIG. 19C) are openings through which leading end portions of the respective positioning pins 104 are inserted. The insertion ports 22*ho* are formed in end portions of the pipes 22 disposed corresponding to the respective medium storage boxes 12. The pipes 22 are disposed inside each medium storage box 12, and are coupled to a liquid spray nozzle 18 TP, described later, and the liquid spray nozzles 18Re, 18R, and 18L (see FIG. 20).

The leading end portion of each positioning pin 104 is inserted into the respective insertion port 22*ho* when the upper section 11U that was in an open state is closed. Thus, the positioning pins 104 couple the casing inner flow-paths and the unit inner flow-paths together, and position the casing inner flow-paths and the unit inner flow-paths.

When the upper section 11U that was in a closed state is opened, the leading end portions of the positioning pins 104 are extracted from the respective insertion ports 22*ho*. Thus, the casing inner flow-paths and the unit inner flow-paths are separated from each other.

As illustrated in FIG. 19A and FIG. 19B, the leading end portion of each positioning pins 104 is formed tapered, such that the leading end portion of the positioning pins 104 may be easily inserted into the respective insertion port 22*ho*. As illustrated in FIG. 19C, an outer profile of a lateral direction cross-section of the leading end portion of each positioning pin 104 is formed in a circular shape, and an inner profile of a lateral direction cross-section of the respective insertion port 22*ho* is formed in an elongated hole shape.

Each positioning pin 104 is configured such that the inside is formed in a hollow shape, and ink fed out from the liquid tanks 21 flows inside the positioning pin 104.

As illustrated in FIG. 18A, the liquid spraying mechanism 9E includes the gas generators 103 close to the liquid tanks 21. As illustrated in FIG. 19A, the liquid spraying mechanism 9E also includes liquid pressing plates 102 above the respective liquid tanks 21.

Each gas generator 103 is a pressurizing mechanism that pressurizes the respective liquid pressing plate 102. The liquid pressing plate 102 is a plate member that presses and squashes the respective liquid tank 21 to feed out ink stored inside the liquid tank 21 toward the positioning pin 104 side.

As illustrated in FIG. 19A and FIG. 19B, a sealed space 25 is formed above each liquid pressing plate 102 by the liquid pressing plate 102 and an inner wall face of the casing section 11E. A non-illustrated pipe of the respective gas generator 103 is connected to the sealed space 25.

A lid (or a valve) 105 is disposed between each liquid tank 21 and positioning pin 104. The lid 105 is normally (when an emergency has not occurred) a sealing member such that ink does not flow out from the liquid tank 21 side toward the positioning pin 104 side.

Each pipe 22 is disposed at a location where the leading end portion of the respective positioning pin 104 is inserted. The insertion port 22*ho* is formed in the end portion of each pipe 22.

As illustrated in FIG. 20, the pipes 22 are connected to the liquid spray nozzles 18. In the sixth exemplary embodiment, since the liquid spraying mechanism 9E may use a relatively large amount of ink, the liquid spraying mechanism 9E is configured including the liquid spray nozzle 18TP as a liquid spray nozzle 18 in addition to the liquid spray nozzles 18Re, 18R, and 18L.

The liquid spray nozzle 18TP is a nozzle disposed parallel to an upper face of the stacked medium, at a position at the same height as the upper face (or at a height above the upper face) of the stacked medium stacked inside the stackable space 24. Liquid spray holes of the liquid spray nozzle 18TP are formed facing toward the upper face of the stacked medium.

Operation of Liquid Spraying Mechanism

Explanation follows regarding operation of the liquid spraying mechanism 9E, with reference to FIG. 19B.

When an emergency has occurred, first, the controller of the cash handling device 1 outputs an ink spray command to the non-illustrated liquid spray controller provided inside the liquid spraying mechanism 9E.

In response thereto, the non-illustrated liquid spray controller of the liquid spraying mechanism 9E actuates the gas generators 103. Gas is generated when the gas generators 103 are actuated. The generated gas flows instantaneously into the sealed spaces 25 and fills the sealed spaces 25. The sealed spaces 25 filled with gas thereby press the respective liquid pressing plates 102 downward.

The liquid pressing plates 102 move downward, pressing and squashing the liquid tanks 21. When this occurs, ink inside the liquid tanks 21 breaks through the respective lids 105 provided corresponding to the respective positioning pins 104 of the five medium storage boxes 12. Thus, a relatively large amount of ink flows into the respective positioning pins 104, passes through the pipes 22, and flows into the respective medium storage boxes 12.

The relatively large amount of ink that has flowed into the respective medium storage boxes 12 is sprayed through the liquid spray nozzles 18TP, 18Re, 18R, and 18L (see FIG. 20) toward the stacked medium. Ink spreads across the end faces of the stacked medium when this occurs. The liquid spraying mechanism 9E thereby stains a large number of sheets of the medium.

As explained above, the liquid spraying mechanism 9E according to the sixth exemplary embodiment enables the stained surface area of each medium stacked in the vertical direction to be increased and all the media to be stained over a wide range, similarly to the liquid spraying mechanisms 9 to 9D according to the first to fifth exemplary embodiments.

Moreover, the liquid spraying mechanism 9E enables the medium storage boxes 12 to be made lighter in weight and more compact, enables the number of stored sheets of medium to be increased, and also enables a relatively larger amount of ink to be sprayed and a larger number of sheets of medium to be stained, compared to the liquid spraying mechanisms 9 to 9D according to the first to fifth exemplary embodiments.

Seventh Exemplary Embodiment

A seventh exemplary embodiment provides a liquid spraying mechanism 9F in which an expanding member that expands in volume when containing ink is disposed at the periphery of the stacked medium (stackable space 24), and a large number of sheets of medium are also stained by the expanding member.

Figure 21:
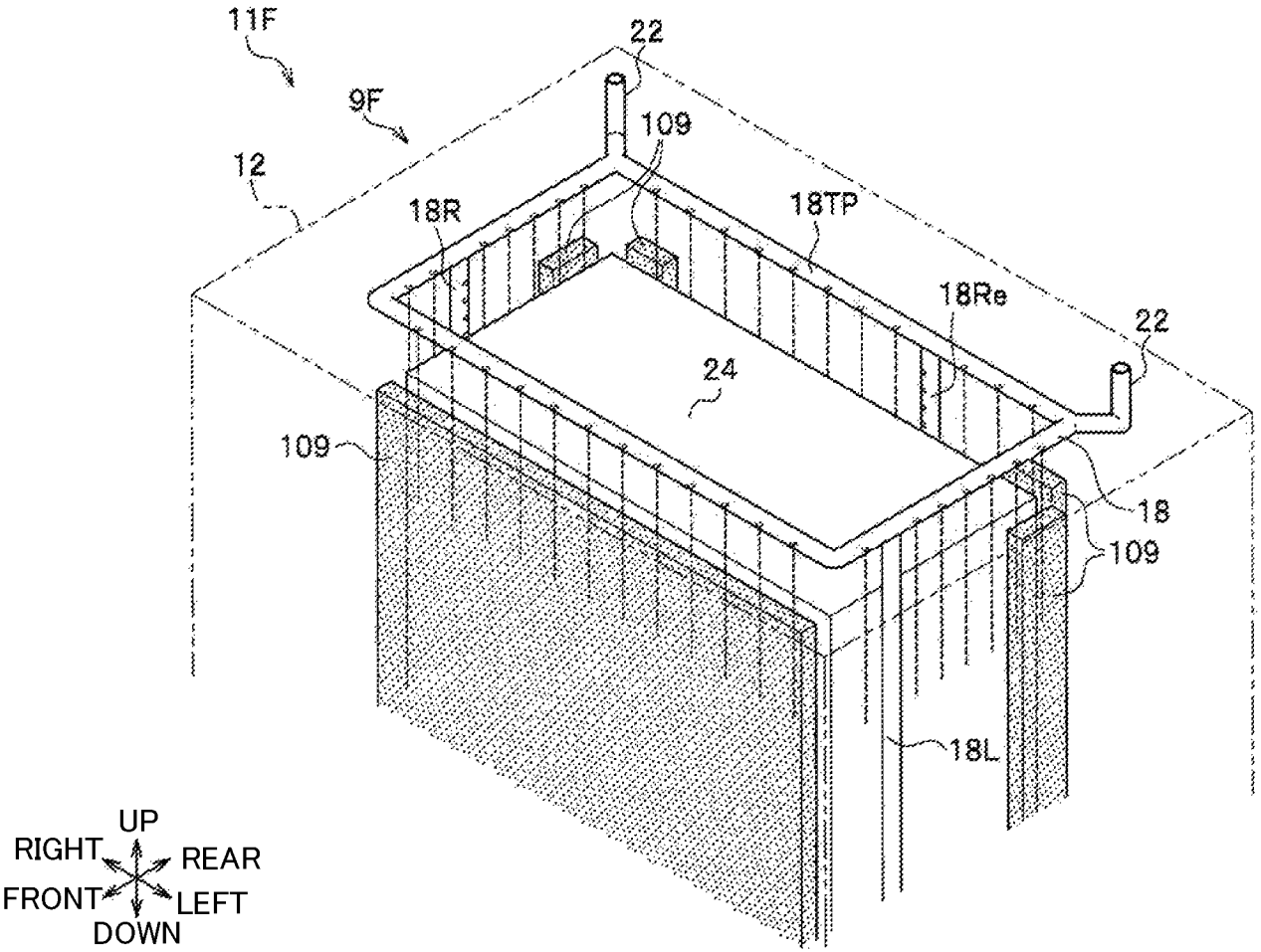
FIG. 21 is a drawing schematically illustrating a configuration of a liquid spraying mechanism according to a seventh exemplary embodiment.

Explanation follows regarding a configuration of the liquid spraying mechanism 9F according to the seventh exemplary embodiment, with reference to FIG. 21. FIG. 21 is a drawing schematically illustrating a configuration of the liquid spraying mechanism 9F according to the seventh exemplary embodiment.

As illustrated in FIG. 21, the liquid spraying mechanism 9F according to the seventh exemplary embodiment differs from the liquid spraying mechanism 9E according to the sixth exemplary embodiment (see FIG. 20) in that sponges 109 are included at the periphery of the stacked medium (stackable space 24).

Note that configuration of the liquid spraying mechanism 9E is illustrated with the respective guide members 17F, 17Re, 17R, and 17L omitted in FIG. 21. However, the respective guide members 17F, 17Re, 17R, and 17L are present in practice.

The sponges 109 are expanding members that expand in volume when containing ink. The sponges 109 are configured by a macromolecule polymer material that has a property of expanding in volume when containing ink. The sponges 109 are disposed at the periphery of any one or plural end faces of the four side faces of the stacked medium stacked inside the stackable space 24.

Explanation follows regarding operation of the liquid spraying mechanism 9F.

The ink spraying operation of the liquid spraying mechanism 9F according to the seventh exemplary embodiment is the same as the ink spraying operation of the liquid spraying mechanism 9E according to the sixth exemplary embodiment.

However, in the seventh exemplary embodiment, ink sprayed from the respective liquid spray nozzles 18TP, 18RE, 18R, and 18L adheres to the sponges 109 disposed at the periphery of the stacked medium. The volume of the sponges 109 expand when the ink adheres. The sponges 109 and the stacked medium are thereby in a closely contacted state. Ink seeps out from the sponges 109 when this occurs. Thus, the liquid spraying mechanism 9F enables ink that has seeped out to be made to adhere to the stacked medium and a large number of sheets of medium to be stained.

The liquid spraying mechanism 9F thereby enables a large number of sheets of medium to be stained by ink that has adhered to the sponges 109, in addition to ink that is directly sprayed from the respective liquid spray nozzles 18TP, 18RE, 18R, and 18L onto the stacked medium, and ink flowing at the periphery of the stacked medium. Thus, the liquid spraying mechanism 9F enables the stained surface area of each medium to be further increased compared to the liquid spraying mechanism 9E according to the sixth exemplary embodiment.

As explained above, the liquid spraying mechanism 9F according to the seventh exemplary embodiment enables the stained surface area of each medium stacked in the vertical direction to be increased and all the media to be stained over a wide range, similarly to the liquid spraying mechanisms 9 to 9E according to the first to sixth exemplary embodiments.

Moreover, the liquid spraying mechanism 9F enables the stained surface area of each medium to be further increased compared to the liquid spraying mechanism 9E according to the sixth exemplary embodiment.

Eighth Exemplary Embodiment

The eighth exemplary embodiment provides a liquid spraying mechanism 9G in which the liquid tanks 21 are disposed below the medium storage boxes 12.

Figure 22A:
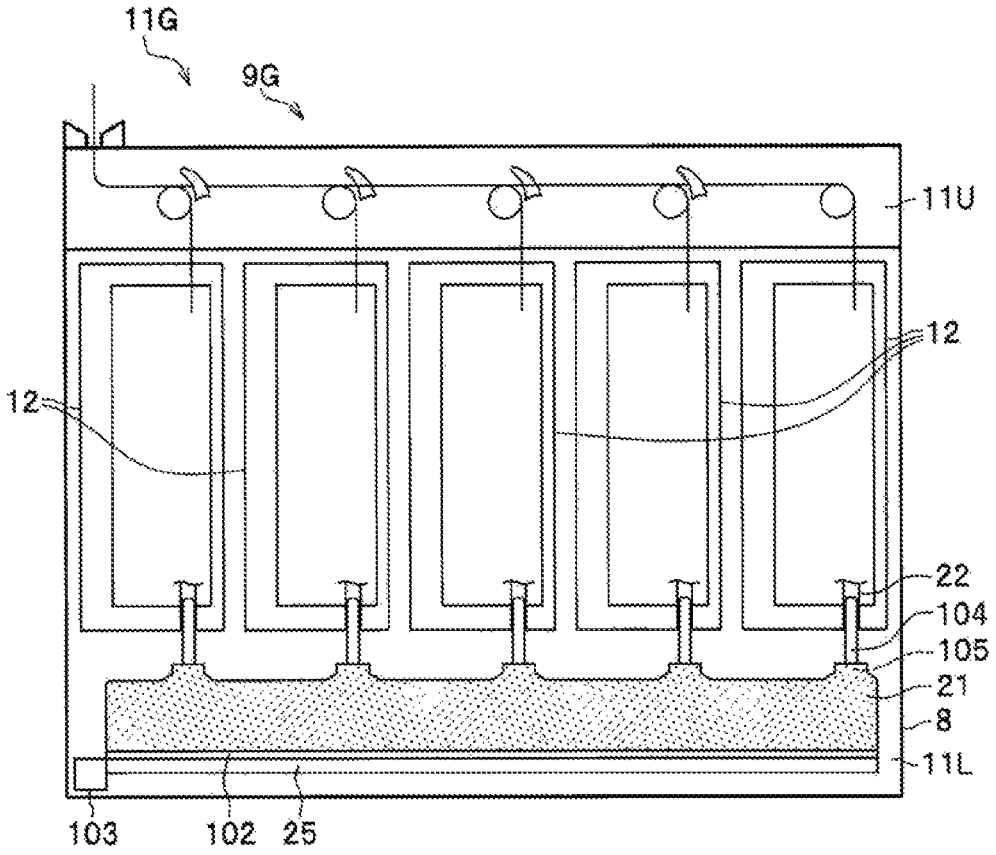
FIG. 22A is a drawing schematically illustrating a configuration of a liquid spraying mechanism according to an eighth exemplary embodiment.
Figure 22B:
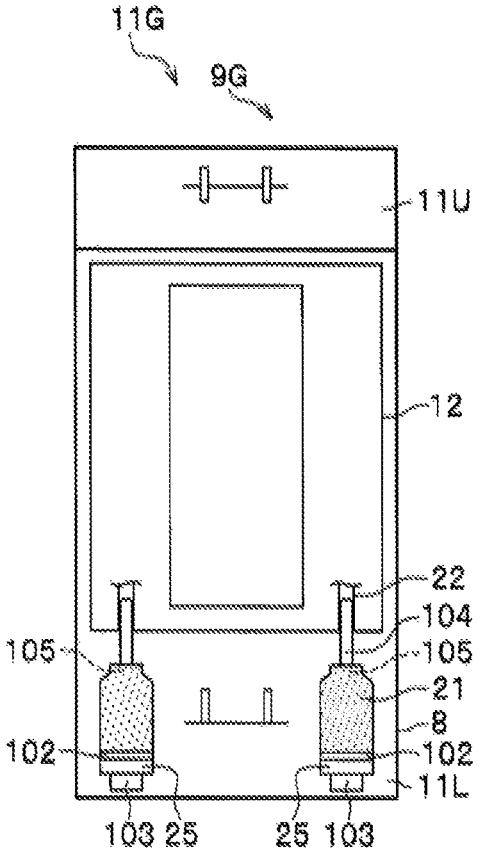
FIG. 22B is a drawing schematically illustrating a configuration of the liquid spraying mechanism according to the eighth exemplary embodiment.
Figure 23:
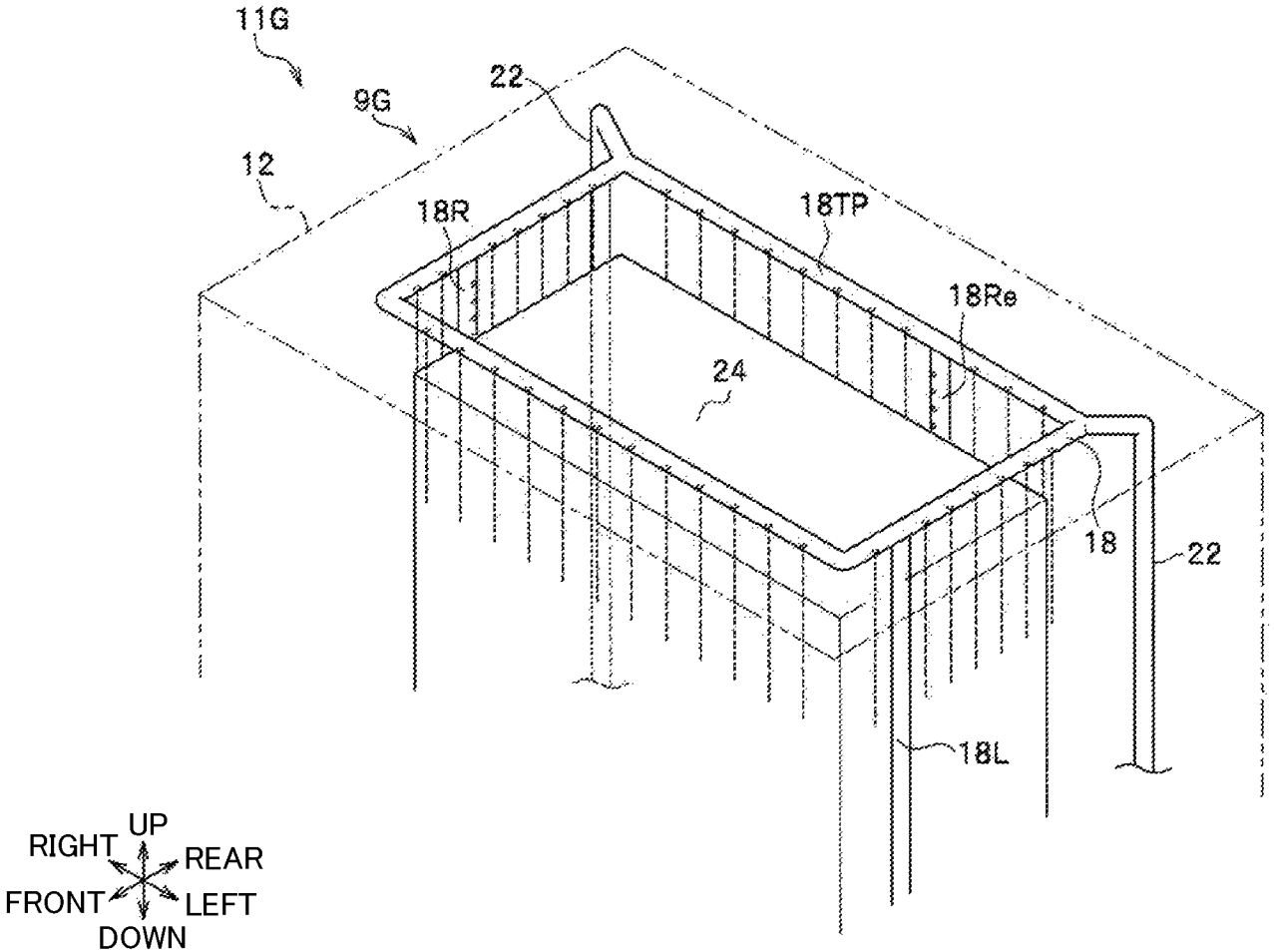
FIG. 23 is a drawing illustrating a configuration of liquid spray nozzles of the liquid spraying mechanism according to the eighth exemplary embodiment.

Explanation follows regarding a configuration of the liquid spraying mechanism 9G according to the eighth exemplary embodiment, with reference to FIG. 22A to FIG. 22B and FIG. 23. FIG. 22A to FIG. 22B are drawings schematically illustrating a configuration of the liquid spraying mechanism 9G according to the eighth exemplary embodiment. FIG. 22A illustrates a configuration of the liquid spraying mechanism 9G as viewed from the side. FIG. 22B illustrates a configuration of the liquid spraying mechanism 9G as viewed from the front. FIG. 23 is a drawing illustrating a configuration of the liquid spray nozzles 18 of the liquid spraying mechanism 9G.

As illustrated in FIG. 22A and FIG. 22B, the liquid spraying mechanism 9G according to the eighth exemplary embodiment differs from the liquid spraying mechanism 9E according to the sixth exemplary embodiment in the respect that the liquid tanks 21 are disposed below the medium storage boxes 12.

The liquid tanks 21 are disposed at a bottom portion of the lower unit 8 where the medium storage boxes 12 are loaded. In the eighth exemplary embodiment, the ink storage amount of the liquid tanks 21 is larger than the total ink storage amount of the two liquid tanks 21*a*, 21*b* for the five medium storage boxes 12 of the liquid spraying mechanisms 9 to 9D according to the first to fifth exemplary embodiments.

The positioning pins 104 are connected to the liquid tanks 21 in order to align position with the respective medium storage boxes 12 loaded in a casing section 11G. The positioning pins 104 are configured so as to be inserted into the respective insertion ports 22*ho* (see FIG. 19A to FIG. 19C), formed in the end portions of the pipes 22 disposed corresponding to the respective medium storage boxes 12.

The pipes 22 are disposed so as to extend along the vertical direction. A lower end portion of each pipe 22 is disposed at a position capable of connecting with the respective positioning pin 104. As illustrated in FIG. 23, an upper end portion of each pipe 22 is connected to the liquid spray nozzle 18TP disposed at a position at the same height as the upper face (or at a height above the upper face) of the stacked medium stacked inside the stackable space 24.

The gas generators 103 are disposed close to the liquid tanks 21. The liquid pressing plates 102 is disposed below the liquid tanks 21. Each sealed space 25 is formed below the respective liquid pressing plate 102 by the liquid pressing plate 102 and an inner wall face of the casing section 11G. A non-illustrated pipe of each gas generator 103 is connected to the respective sealed space 25.

The lids (or valves) 105 are disposed between the liquid tanks 21 and the positioning pins 104 (see FIG. 19A to FIG. 19C).

The liquid spraying mechanism 9G has similar operation to the liquid spraying mechanism 9E according to the sixth exemplary embodiment, except for there being different movement directions of the liquid pressing plates 102 and flow directions of ink flowing out from the liquid tanks 21.

In the above configuration, the liquid spraying mechanism 9G differs from the liquid spraying mechanism 9E according to the sixth exemplary embodiment in the respect that the liquid tanks 21 and the gas generators 103 are not provided to the sorting conveyance section 7. The liquid spraying mechanism 9G thereby enables the sorting conveyance section 7 to be configured lighter in weight. Thus, the liquid spraying mechanism 9G enables the upper section 11U of the casing section 11G (see FIG. 22A and FIG. 22B) to be more easily lifted than in the liquid spraying mechanism 9E according to the sixth exemplary embodiment. This enables the upper section 11U to be easily lifted when the upper section 11U is lifted by a user such as when attaching or removing the medium storage boxes 12 to and from the casing section 11G.

As explained above, the liquid spraying mechanism 9G according to the eighth exemplary embodiment enables the stained surface area of each medium stacked in the vertical direction to be increased and all the media to be stained over a wide range, similarly to the liquid spraying mechanisms 9 to 9F according to the first to seventh exemplary embodiments.

Moreover, similarly to the liquid spraying mechanism 9E according to the sixth exemplary embodiment, the liquid spraying mechanism 9G enables the medium storage boxes 12 to be lighter in weight and more compact, enables the number of stored sheets of medium to be increased, and also enables a relatively larger amount of ink to be sprayed and a larger number of sheets of medium to be stained, compared to the liquid spraying mechanisms 9 to 9D according to the first to fifth exemplary embodiments.

The liquid spraying mechanism 9G also enables the upper section 11U of the casing section 11G (see FIG. 22A and FIG. 22B) to be more easily lifted than in the liquid spraying mechanism 9E according to the sixth exemplary embodiment.

The present disclosure is not limited to the above-described exemplary embodiments, and various modifications and changes may be implemented within a range not departing from the spirit of the present invention.

For example, the above exemplary embodiments have been explained in detail in order to facilitate understanding of the spirit of the present disclosure. Thus, the exemplary embodiments are not necessarily limited to including all of the configurations explained. Moreover, part of the configuration of one exemplary embodiment may be added to, or switched with, the configuration of another exemplary embodiment. Part of the configuration may also be omitted from the configuration of an exemplary embodiment.

For example, the liquid spraying mechanism 9, 9A, 9B, 9C, 9D may be applied to a component that stores medium other than the medium storage boxes 12, such as the rejection box 6 (see FIG. 1).

Figure 24A:
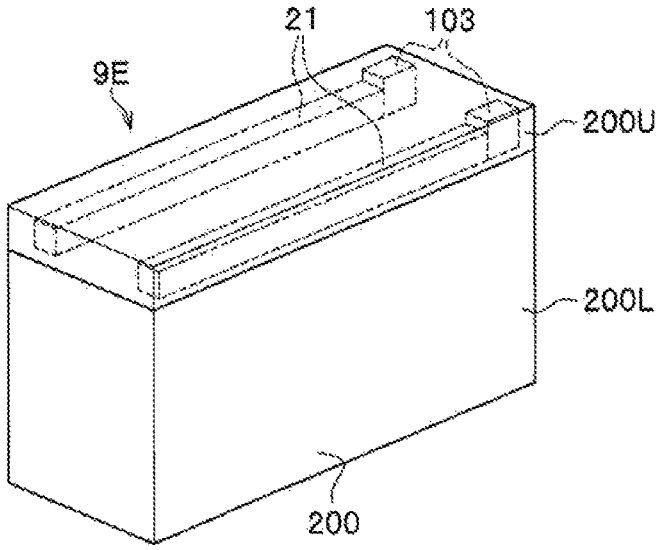
FIG. 24A is a drawing schematically illustrating a configuration of a transportation case applied with a liquid spraying mechanism according to the exemplary embodiments.
Figure 24B:
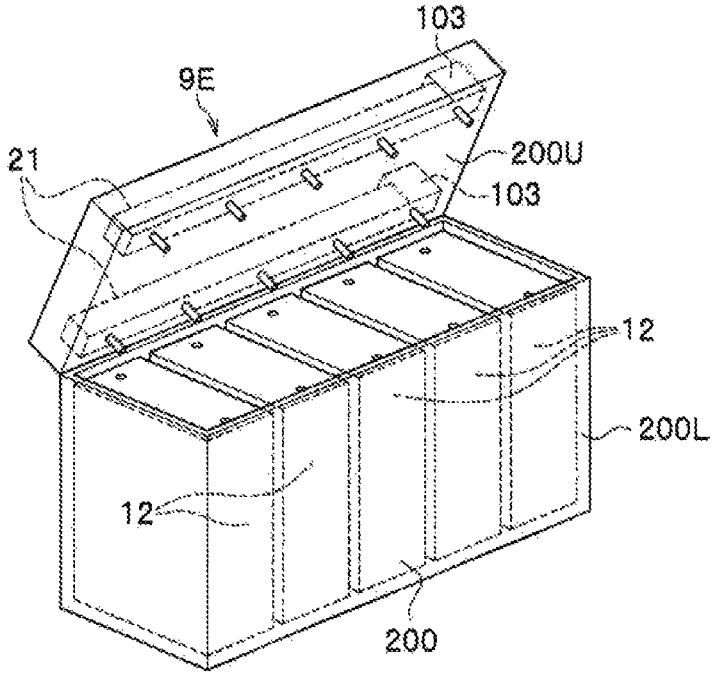
FIG. 24B is a drawing schematically illustrating a configuration of a transportation case applied with a liquid spraying mechanism according to the exemplary embodiments.

Alternatively, for example, as illustrated in FIG. 24A to FIG. 24B, the liquid spraying mechanism 9E may be applied to a transportation case 200 for transporting the medium. FIG. 24A to FIG. 24B are drawings schematically illustrating a configuration of the transportation case 200 applied with the liquid spraying mechanism 9E.

As illustrated in FIG. 24A to FIG. 24B, the transportation case 200 includes a lid 200U and a storage section 200L for the medium storage boxes 12. The lid 200U has a similar configuration to the upper section 11U of the casing section 11E according to the sixth exemplary embodiment, except that the sorting conveyance section 7 is not included. The storage section 200L is provided with a mechanism that regulates the attachment positions of the respective medium storage boxes 12, and is configured so as to enable attachment (loading) and removal of the medium storage boxes 12.

The transportation case 200 includes the non-illustrated break-in detection section, the non-illustrated liquid spray controller, and the gas generators 103. In cases in which the transportation case 200 has been broken into, the non-illustrated break-in detection section detects the break-in and outputs a break-in detection signal to the liquid spray controller. The liquid spray controller actuates the gas generators 103 when the break-in detection signal is input.

The transportation case 200 has substantially the same configuration as the casing section 11E according to the sixth exemplary embodiment (see FIG. 17A and FIG. 17B), and includes the liquid spraying mechanism 9E according to the sixth exemplary embodiment (see FIG. 18A to FIG. 20). When an emergency has occurred, such as the transportation case 200 being broken into, the transportation case 200 detects that the transportation case 200 has been broken into and actuates the gas generators 103, thereby enabling similar operation to that of the casing section 11E according to the sixth exemplary embodiment.

Applying the liquid spraying mechanism 9E to the transportation case 200 enables all the media stacked in the vertical direction to be stained over a wide range, not only during transaction processing in the cash handling device 1, but also when transporting the medium using the transportation case 200. Moreover, a relatively large amount of ink may be sprayed and a large number of sheets of medium may be stained.

Note that FIG. 24A to FIG. 24B illustrate a configuration in which the transportation case 200 is capable of storing five medium storage boxes 12. However, the number of storage boxes is not limited to five. The transportation case 200 may be configured so as to transport only one medium storage box 12, or configured so as to transport plural medium storage boxes 12.

The invention claimed is:

1. A medium handling device, comprising:

a stage on which a rectangular shaped medium is stacked in a vertical direction; and a liquid spraying mechanism including a plurality of liquid spray nozzles that extend along the vertical direction and that spray a liquid at a medium stacked on an upper face of the stage, the plurality of liquid spray nozzles being respectively provided at positions facing at least three side edges of the stacked medium, each of the plurality of liquid spray nozzles being provided such that each of the respective three side edges has at least one of the liquid spray nozzles disposed adjacent thereto, each of the plurality of liquid spray nozzles being disposed so as to spray the liquid at a specific spray angle with respect to the respective facing side edge, and the plurality of liquid spray nozzles including at least one length direction nozzle and at least one width direction nozzle, the length direction nozzle facing a length direction side edge of the stacked medium, the width direction nozzle facing a width direction side edge of the stacked medium, the width direction nozzle spraying the liquid toward the length direction side edge.

2. The medium handling device of claim 1, wherein the specific spray angle is 60° degree or smaller.

3. The medium handling device of claim 1, wherein the length direction nozzle is disposed facing the length direction side edge at a position in the vicinity of a center portion of the length direction side edge, and sprays the liquid toward the center portion of the length direction side edge.

4. The medium handling device of claim 1, wherein a liquid spray amount from the length direction nozzle is set so as to be smaller than a liquid spray amount from the width direction nozzle.

5. The medium handling device of claim 1, wherein:

each of the plurality of liquid spray nozzles includes a plurality of liquid spray holes that spray liquid; and the plurality of liquid spray holes of each of the liquid spray nozzles are disposed so as to together span in the vertical direction in a stackable space for stacking the medium.

6. The medium handling device of claim 5, wherein a liquid spray amount of each of the plurality of liquid spray holes is set to an amount according to a height direction position at which each of the plurality of liquid spray holes is disposed.

7. The medium handling device of claim 1, further comprising:

a liquid tank in which the liquid is stored; and a pipe that feeds the liquid stored in the liquid tank to the liquid spray nozzles, when liquid fed out from the liquid tank is branched and distributed to the plurality of liquid spray nozzles, a branch point of the pipe being disposed in a position, with respect to a liquid spray nozzle on one side and a liquid spray nozzle on another side that are disposed facing each other on one side and another side of the stacked medium, such that a distance from the branch point to the one side liquid spray nozzle is the same distance as a distance from the branch point to the other side liquid spray nozzle.

8. The medium handling device of claim 1, further comprising:

a length direction guide member with a guide face disposed so as to abut a length direction side edge of the stacked medium; and a width direction guide member with a guide face disposed so as to abut a width direction side edge of the stacked medium, the guide faces of the length direction guide member and the width direction guide member being formed at positions at which liquid sprayed from the liquid spray nozzles flows across the guide faces.

9. The medium handling device of claim 8, wherein:

a plurality of ribs that project out toward a stackable space for stacking the medium are formed to the guide face of the length direction guide member; and each of the plurality of ribs includes an inclined face formed on the side furthest from a center portion of the guide face, such that an interior angle with the guide face is an acute angle.

10. The medium handling device of claim 8, wherein:

a plurality of ribs that project out toward a stackable space for stacking the medium are formed to the guide face of the length direction guide member;

a plurality of openings are formed on each of the plurality of ribs, the plurality of openings being formed on the guide face so as to cross the plurality of ribs and pierce through the plurality of ribs in an oblique direction; and the openings function as pathways for the liquid.

11. The medium handling device of claim 1, further comprising a controller that causes spraying of the liquid by each of the plurality of liquid spray nozzles to be performed at a plurality of times.

12. The medium handling device of claim 1, further comprising:

a liquid tank in which the liquid is stored; and a casing section that is capable of being loaded with at least one unit provided with the liquid tank, the stage, and the liquid spray nozzles, the liquid tank supplying the liquid to all of the units loaded in the casing section.

13. The medium handling device of claim 12, wherein:

the casing section includes therein a sorting conveyance section that conveys the medium to any of the at least one unit while sorting the medium; and the liquid tank is disposed at the periphery of the sorting conveyance section.

14. The medium handling device of claim 12, wherein the liquid tank is disposed below the at least one unit loaded in the casing section.

15. The medium handling device of claim 12, wherein:

each of the at least one unit includes a unit inner flow-path that supplies the liquid to each of the liquid spray nozzles; and the casing section includes a casing inner flow-path that supplies liquid fed out from the liquid tank to each of the at least one unit, and a coupling mechanism that couples the unit inner flow-path and the casing inner flow-path together.

16. The medium handling device of claim 15, wherein:

the coupling mechanism includes a pin disposed at an end portion of the casing inner flow-path and an insertion port formed at an end portion of the unit inner flow-path; and the pin is formed in a hollow shape such that the liquid flows inside and is inserted into the insertion port so as to position the casing inner flow-path and the unit inner flow-path, and to couple the casing inner flow-path and the unit inner flow-path together so as to be capable of separating from each other.

17. The medium handling device of claim 12, wherein:

each of the at least one unit includes a liquid spray nozzle at a position above a stackable space where the medium is stacked, the liquid spray nozzle being disposed extending in a direction parallel to an upper face of the medium stacked in the stackable space and formed with a liquid spray hole facing toward the stackable space.

18. The medium handling device of claim 12, wherein each of the at least one unit includes, therein and at the periphery of a stackable space for stacking the medium, an expanding member that has a property of expanding in volume when containing the liquid.

* * * * *